US006159137A

United States Patent [19]

Lee et al.

[11] Patent Number: 6,159,137

[45] Date of Patent: Dec. 12, 2000

[54] APPARATUS FOR FOLDING SHEET MATERIAL HAVING IMPROVED SLITTING, SCORING/CRUSHING, GATHERING, AND FOLDING SECTIONS OR DEVICES

[76] Inventors: Stanley M. Lee, 12510 Exbury Ct., Tomball, Tex. 77375; Ken N. Winebarger, 6019 Crane Dr., Lakeland, Fla. 33809

[21] Appl. No.: 09/262,720

[22] Filed: Mar. 4, 1999

Related U.S. Application Data

[60] Provisional application No. 60/077,278, Mar. 9, 1998, and provisional application No. 60/094,958, Jul. 31, 1998.

[51] Int. Cl.[7] ..... B31B 1/14; B31B 1/62; B31B 1/26

[52] U.S. Cl. ..... 493/355; 493/60; 493/64; 493/151; 493/185; 493/367; 493/399; 493/402

[58] Field of Search ..... 493/60, 64, 128, 493/131, 151, 185, 355, 331, 366, 367, 397, 399, 401, 340, 402, 476

[56] References Cited

U.S. PATENT DOCUMENTS 4,285,684 8/1981 Smith .
4,792,325 12/1988 Schmidtke ..... 493/399
5,184,558 2/1993 Wozniacki ..... 493/355
5,207,631 5/1993 Schmidtke et al. ..... 493/402
5,378,221 1/1995 Lauderbaugh et al. .

*Primary Examiner*—Brian L. Johnson
*Assistant Examiner*—Matthew Luby
*Attorney, Agent, or Firm*—Marshall & Melhorn

[57] ABSTRACT

A apparatus for manufacturing an object of a folded sheet material has improved slitting, scoring/crushing, gathering, and folding sections or devices. Qualifying means, slitting means, and scoring/crushing means are adjustable with respect to a flat, planer, path of movement so that sheet material moves through the machine without causing the paper to assume an "S" shape, or otherwise suffer loss of paper control. Qualifying means bring within tolerance, sheet which is over thickness. Identifying rollers identify and slightly pre-fold a blank before it enters a gathering and pre-folding section. Novel slitting and scoring heads are easily changed in number or configuration, and have easily replaceable split blades.

42 Claims, 24 Drawing Sheets

APPARATUS FOR FOLDING SHEET MATERIAL HAVING IMPROVED SLITTING, SCORING/CRUSHING, GATHERING, AND FOLDING SECTIONS OR DEVICES

This application is claiming the benefit, Under 35 U.S.C. § 119 (*e*), of the provisional application filed on Mar. 9, 1998, under 35 U.S.C. § 111(*b*), which was granted Ser. No. 60/077,278, and of the provisional application filed on Mar. 9, 1998, under 35 U.S.C. § 111(*b*), which was granted Ser. No. 60/094,958 filed Jul. 31, 1998. The provisional applications, Ser. Nos. 60/077,278 and 60/094,958, are hereby incorporated by reference.

BACKGROUND OF THE INVENTION

1. Field of the Invention

The present invention relates to a method and apparatus for manufacturing an object of a folded sheet material. More particularly, the present invention relates to a continuous method and apparatus for manufacturing an object out of a corrugated fiberboard material. Most particularly, the present invention relates to a method and apparatus for making stringers and cross stringers, to be assembled into pallets, from corrugated fiberboard material.

2. Discussion of the Related Art

Methods and apparatus for making stringers and cross stringers from corrugated fiberboard material are shown in the art. U.S. Pat. No. 4,792,325, issued Dec. 20, 1988, to Schmidtke discloses a method and apparatus for continuously making cardboard runners and stringers and assembling them into a cardboard pallet. Whether a runner or stringer is involved, the method involves essentially supplying a fiberboard blank of appropriate composition in size, running the blank through a perforating and scoring roller to produce fold lines in the blank, and progressively folding the blank from the outside in, by passing it through a plurality of curvilinear rods, and supplying adhesive to portions of the blank during the folding process. The runners and stringers thus produced are assembled together to form a cardboard pallet.

U.S. Pat. No. 5,207,631, issued May 4, 1993, to Schmidtke, et. al., shows a method and apparatus for folding of sheet material into symmetrical and non-symmetrical shapes. The method involves, essentially, supplying a sheet of material such as a fiberboard blank of appropriate composition and size, running the blank through crushing and scoring rollers to produce fold lines in the blank, and asymmetrically (making more folds from one side of the blank than from the other side) or symmetrically folding the blank into a predetermined shape while applying adhesive at predetermined points. The blank is folded by passing it through a multi-function folding means, including a lifting means, which can slightly lift the outside edge of the blank until a belt-like folding and propelling means can then fold one panel of a blank over onto the other panel while adhesive is being applied.

While the machines in the art were certainly capable of manufacturing pallet members from corrugated fiberboard material, they proved unsuitable for continuous production use. Problems were encountered with the inability of the machines to handle paper which was over tolerance in thickness, the inability to propel the paper along a flat, horizontal plane of movement through the crushing and scoring sections, instead imparting a slight "S" shape to the paper, and the inability to control the fast moving corrugated paperboard (loss of paper control) in the folding stations.

Thus, those skilled in the art continued to search for a high volume production method and apparatus for folding sheet material.

SUMMARY OF THE INVENTION

The method and apparatus of the present invention solves the problems found in the art in several ways. An improved slitting and scoring/crushing section has a qualifying means adjustable with respect to a flat plane of movement to qualify, or bring within tolerance, corrugated paperboard which is over thickness. Out of tolerance paperboard can affect the folding operation in later stages.

The slitting means, which slit the corrugated paperboard or fiberboard, are adjustable with respect to the flat plane of movement, like the crushing/scoring means. All operations are performed properly, while still maintaining the flat line of feed or horizontal paper path through the machine, without causing the paper to assume a "S" shape because of loss of paper control.

An identifying roller section and a gathering and pre-folding section is provided to more easily make a number of folds than previously possible. A number of active folding devices are used to make the remaining folds, which provide better control of the rapidly moving fiberboard than was heretofore possible.

Also, novel slitting and scoring/crushing heads are provided so that the machine may easily and rapidly be changed from manufacturing one size and/or configuration of pallet member to another without extensive disassembly and down time of the machine.

Thus, the method and apparatus of the present invention solves the problems in the prior art by slitting and/or scoring and/or crushing a blank of sheet material at a number of predetermined positions to provide a predetermined series of fold lines and corresponding panels in said sheet, all the while moving the corrugated paperboard or fiberboard along a horizontal plane or flat line of movement without distortion or the loss of paper control.

After the blank passes through the slitting and/or scoring and/or crushing operation, the apparatus then folds and gathers the blank at the fold lines by first moving the blanks through identifying rollers and a gathering section while applying glue at appropriate areas to the pre-folded panels, all while longitudinally propelling the blank through the apparatus under total paper control. The remainder of the folds are made by propelling the blank through a series of hinged folding means, while further applying glue to secure the blank in the shape of the part being manufactured.

In one embodiment of the present invention a novel method and apparatus for manufacturing parts formed of fiberboard is provided.

In another embodiment of the invention, a novel method and apparatus for the manufacture of corrugated pallet members is provided.

In another embodiment of the present invention, a novel method and apparatus for the manufacture of cross stringers used in corrugated pallets is provided.

In yet another embodiment of the present invention, a novel method and apparatus for the manufacture of stringers used in corrugated pallets is provided.

In still another embodiment of the present invention, a novel apparatus for slitting and/or scoring and/or crushing corrugated fiberboard is provided.

In another embodiment of the present invention, a novel gathering and pre-folding mechanism is provided.

In yet another embodiment of the invention, a novel active and hinged folding mechanism is provided.

In yet another embodiment of the present invention, a unique folding mechanism for folding corrugated paperboard or fiberboard is provided.

Thus, it is an object of the present invention to provide an improved method and apparatus for manufacturing parts out of folded corrugated paperboard or fiberboard or sheet material.

It is another object of the present invention to provide an improved method and apparatus for the manufacturing of parts from folded corrugated paperboard or fiberboard material which is capable of high volume production without distorting the material or being subject to jamming.

Another object of the present invention is to provide an apparatus of the foregoing nature having an improved slitter scorer section.

Another object of the present invention is to provide an apparatus of the foregoing nature having an improved gathering and pre-folding section.

Yet another object of the present invention is to provide an apparatus of the foregoing nature having easily changeable slitting and scoring heads.

A further object of the present invention is to provide an apparatus of the foregoing nature having active folding means.

Further objects and advantages of the present invention will be apparent from the following description and appended claims, reference being made to the accompanying drawings forming a part of the specification, wherein like reference, characters designate corresponding parts in the several views.

It is to be understood that the present invention is not limited in its application to the details of construction and arrangement of parts illustrated in the accompanying drawings, since the invention is capable of other embodiments, and of being practiced or carried out in various ways within the scope of the claims. Also, it is to be understood that the phraseology and the terminology employed herein is for the purpose of description, and not of limitation.

DESCRIPTION OF THE PREFERRED EMBODIMENT

Figure 1:
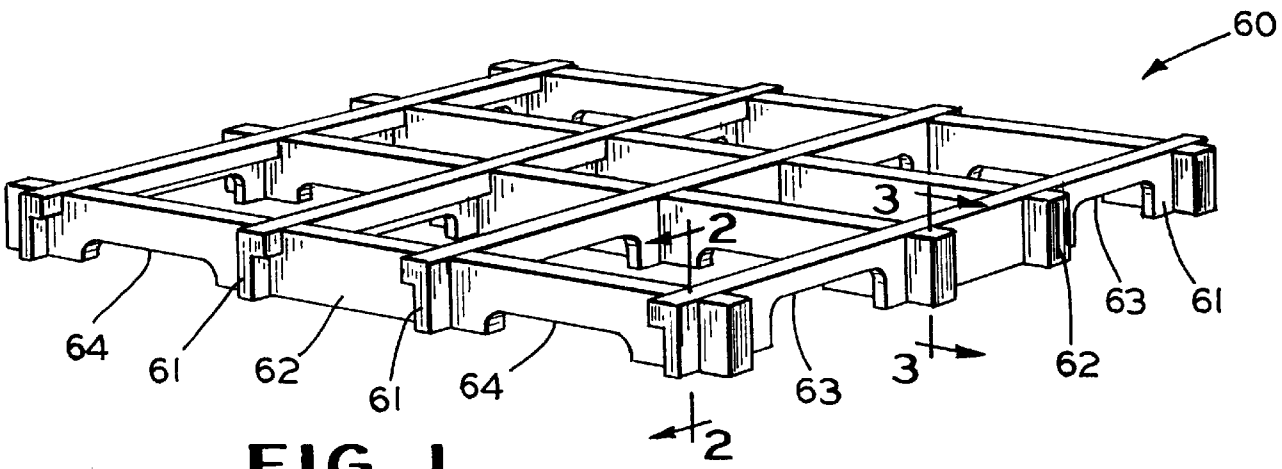
FIG. 1 is a perspective view of a corrugated paperboard pallet having pallet members manufactured according to the method and apparatus of the present invention.

Referring to FIG. 1, there is shown a product made of corrugated paperboard or fiberboard in the form of a pallet, generally designated by the numeral 60. While the pallet 60 is illustrated, it should be understood that this is used by way of example, and a wide range of corrugated paperboard, fiberboard, or other sheet materials may be used to form a wide variety of products using the method and apparatus of the present invention. Such products may be such as pallets, corner posts, internal packaging supports, or any other practicable product made of a sheet material, whether the sheet material be made of paper, corrugated paperboard, fiberboard, plastic, or other material, and whether the product so made has only one fold therein, or multiple folds.

Figure 3:
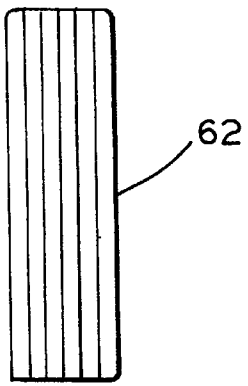
FIG. 3 is a sectional view, taken in the direction of the arrows, along the section line 3—3 of FIG. 1.
Figure 2:
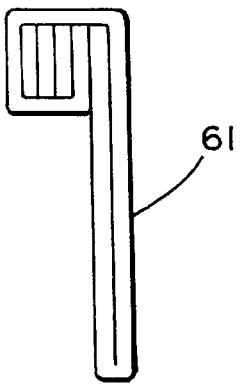
FIG. 2 is a sectional view, taken in the direction of the arrows, along the section line 2—2 of FIG. 1.

With reference to FIGS. 1–3, the cross-stringers and stringers making up pallet 60 may be identical, or different. In the embodiment shown, cross-stringer 61 and stringer 62 are of different cross-section. Each cross stringer 61 may have a plurality of notches 63 in which to insert the fork tines of a fork lift truck or pallet jack. Likewise, each of the stringers 62 may have a notch 64 into which to insert the fork lift or pallet jack tines. Generally, the notch 64 in the stringer 62 is smaller than the notch 63 in the cross-stringer 61 because, in the typical pallet construction, the cross section of the stringer 62 will be smaller than the cross-section of the cross-stringer 61. However, the notches (63,64) may be of the same or different sizes as desired.

Figure 4:
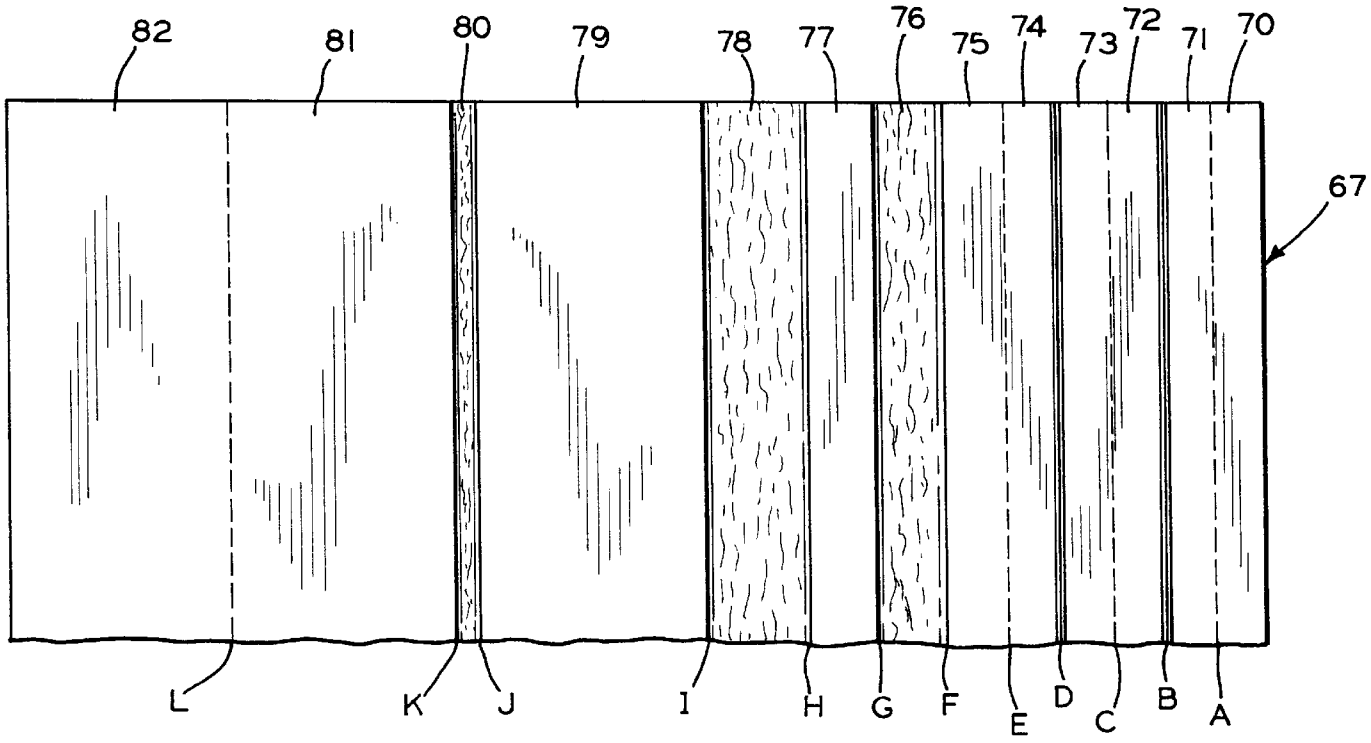
FIG. 4 is a partial plan view of a corrugated paperboard or fiberboard blank before being folded by the apparatus of the present invention into the cross-stringer shown in FIGS. 1–2.
Figure 5:
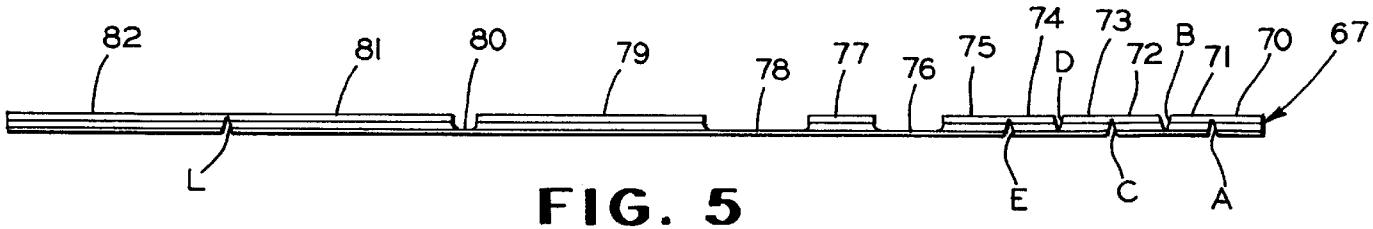
FIG. 5 is an elevational view of the construction shown in FIG. 4.

Referring to FIG. 4–5, there is shown a first or cross-stringer blank 67 immediately after it has passed through the slitting and scoring/crushing means 100 to be hereinafter described. For ease of illustration, the holes which have been previously punched in the cross-stringer blank 67 to form the notches 63 described hereinabove have been omitted. The pre-punching of the cross-stringer blank 67 is optional, well known in the art, and forms no part of the present invention.

Certain areas of the cross-stringer blank 67 have been scored and crushed by the slitting and scoring/crushing means 100 to form scored and crushed panels 76, 78, and 80. The cross-stringer blank 67 has also been slit on either the top or bottom as indicated by the letters A,B,C,D,E and L, while fold lines F,G,H,I,J, and K have been introduced by the scoring/crushing means 133 of the slitting and scoring/crushing means 100. Due to the scale of the drawings, such fold lines F–K are not readily visible in FIG. 5, but are illustrated in FIG. 4. Thus, the cross-stringer blank 67, after passing through the slitting and scoring/crushing means 100 has been divided into a plurality of longitudinally extending panels 70–82, including scored/crushed panels 76,78, and 80.

Likewise, the stringer blank 82 (FIGS. 7–8) is shown just after it has passed through a slitting and crushing/scoring means 100A set up to properly slit and score/crush said stringer blank. Scored/crushed panels have been provided as indicated at 84 and 86, with fold lines M,N,O,P therein, while slits Q,R, and S have been provided in the top or bottom of the blank as illustrated, to form panels 83,85, 87–90.

Figure 8:
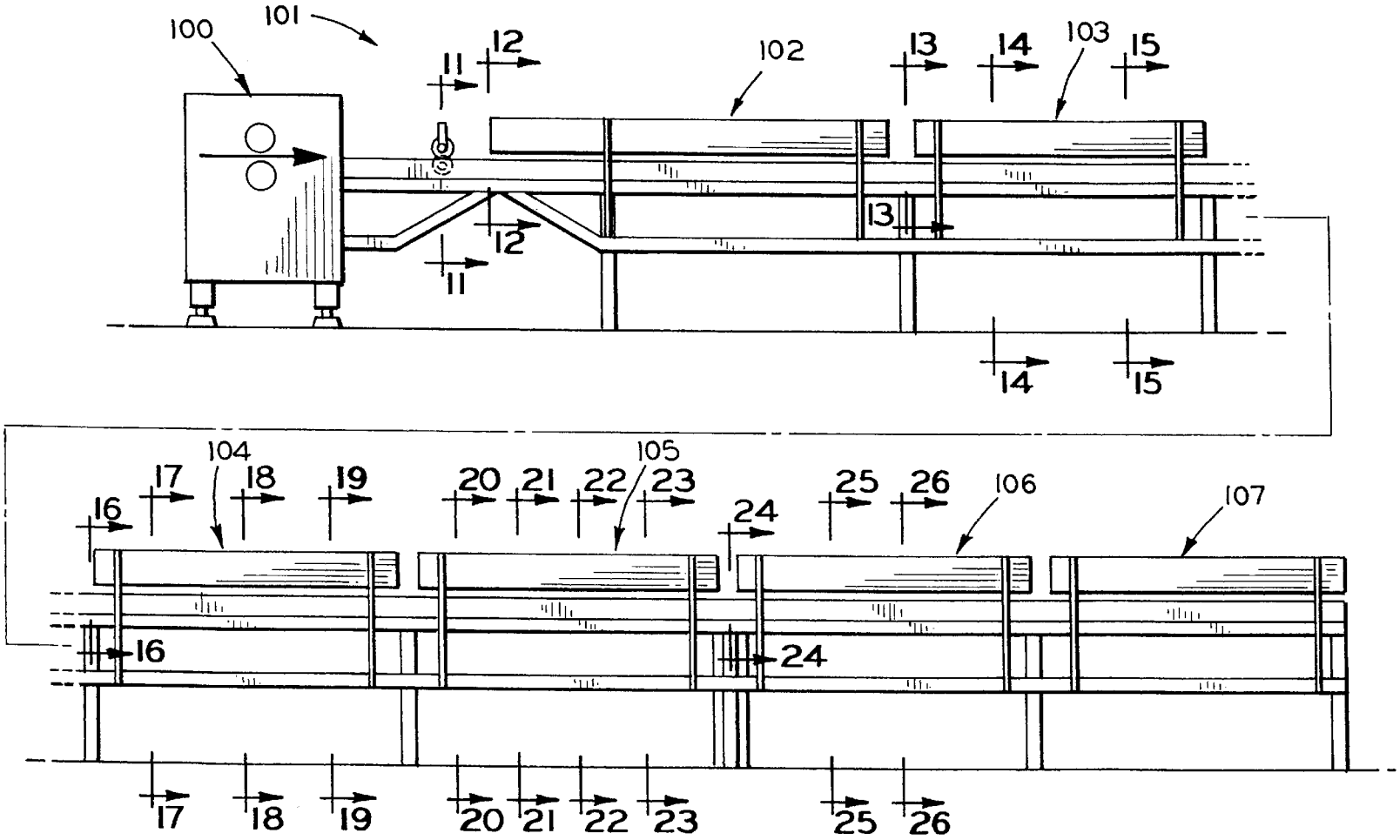
FIG. 8 is an elevational view of a construction embodying the present invention.

Referring to FIG. 8, an apparatus embodying the construction of the present invention to form the cross-stringer blank 67 into the finished cross-stringer 61 is illustrated. The apparatus may include such as a slitting and scoring/crushing means 100, an identifying means 101, a gathering and pre-folding means (left and right side) 102, a first active folding means (left side) 103, second active folding means (right side) 104, third active folding means (right side) 105, fourth active folding means (right side) 106, and first compression means 107. The folding means may be referred to as "active" folding means as they are in motion to perform the folding operation for at least part of the time that the part being folded is passing through them. Means well known in the art are provided to control and operate slitting and scoring/crushing means 100, identifying means 101, gathering and pre-folding means 102, first active folding means 103, second active folding means 104, third active folding means 105, fourth active folding means 106, first compression means 107, as well as any equipment auxiliary thereto, and need not be described in detail herein.

Figure 9:
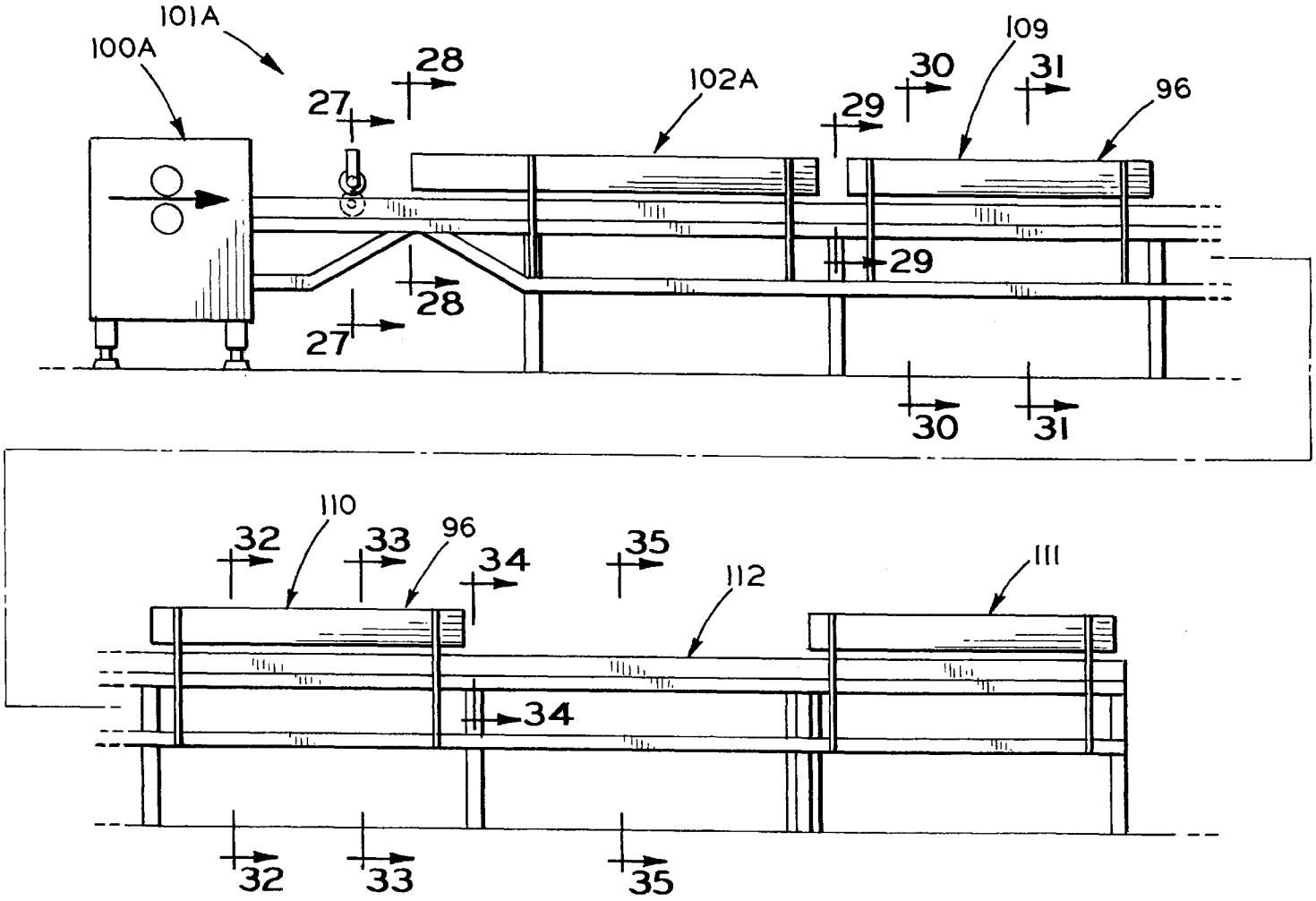
FIG. 9 is an elevational view of a construction embodying a modification of the present invention.

Referring to FIG. 9 there is shown a construction embodying the present invention adapted to manufacture the stringer 62 illustrated in FIG. 3. In this embodiment of the invention there is shown a slitting and scoring/ crushing means 10A, which as will be described hereinafter as similar to the slitting and scoring/crushing means 100. Likewise, the identifying means 101A is similar to the identifying means 101, shown in connection with the embodiment of FIG. 8.

In addition, gathering and pre-folding means 102A is similar to the gathering and pre-folding means 102 shown in the embodiment of the invention illustrated in FIG. 8.

Spaced longitudinally downstream of the gathering and prefolding means 102A is a plurality of hinged folding means 96, such as first active stringer (left side) folding means 109, second active stringer (right side) folding means 110, and a third active stringer (right side) folding means 112. A second compression section 111 is provided downstream from the second stringer folding means 112.

It can be understood that by those skilled in the art that the openings needed in the cross-stringer blank 67 or stringer blank 82 may be present when the blanks (67,82) go through slitting and scoring/crushing means (100, 100A), or may be accomplished in the slitting and scoring/crushing means (100, 100A) simply by the addition of well known cutting dies. However, for ease of understanding, any holes in the blanks 67,82 have simply been omitted, and no cutting apparatus is illustrated in connection with the improved slitting and scoring/crushing means of the present invention.

Figure 10:
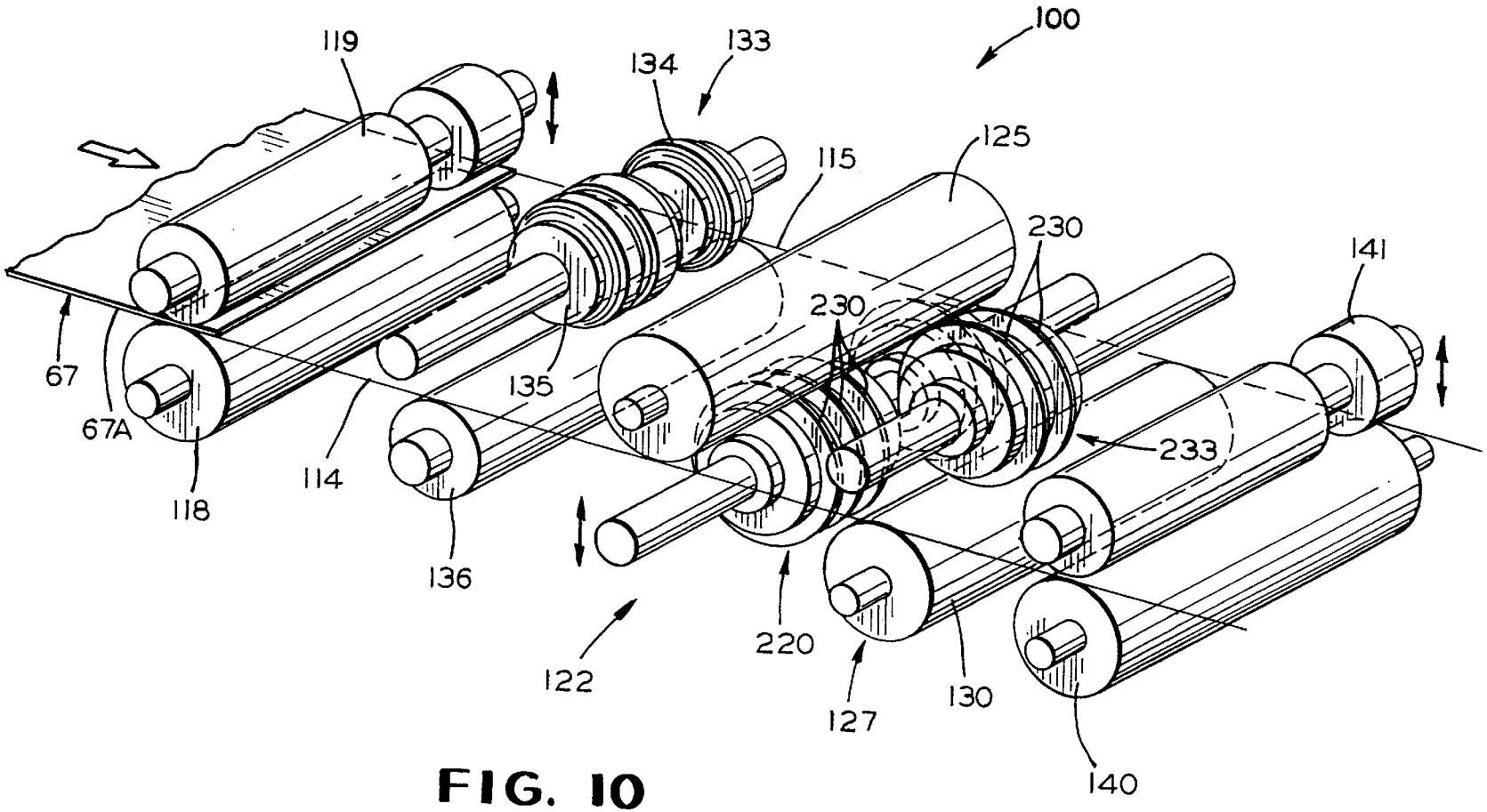
FIG. 10 is a diagrammatic, perspective, view of an improved slitting and scoring/crushing means embodying the present invention, which may be used to form a blank such as that shown in FIG. 5.

Referring now to FIG. 10, an example of a construction embodying the improved slitting and scoring/crushing means 100 of the present invention is illustrated. It is important to note that all of the adjustments to be described are made with regard to a straight line, planar, or flat path (paper line) of movement through the machine indicated by the straight parallel path of movement lines 114 and 115. The horizontal plane defined by these lines will be the straight path of movement which the cross-stringer blank 67 follows through the machines. It is the bottom or underside 67A of the cross-stringer blank 67 which travels in this plane, and it is with regard to this plane that all adjustments are made.

The cross-stringer blank 67 illustrated in FIG. 10 is shown at a position where it has just come between a first lower feed roller 118 and a first adjustable qualifying roller 119. The first lower feed roller 118 would generally be driven, and the path of movement (114,115) would be tangent to its circumference.

The first qualifying roller 119 is vertically adjustable with regard to the first lower feed roller 118, and thus, to the plane of movement (114,115). The first qualifying roller 119 is biased toward the first lower feed roller 118 to maintain sufficient pressure on the cross-stringer blank 67 to cause it to be driven by the first lower feed roller 118, but has an adjustable maximum upward travel such that an over thick or over tolerance cross-stringer blank 67 will not be allowed to pass under the first qualifying roller 119 without being slightly crushed into, or at least close to, the maximum thickness permitted for the cross-stringer blank 67 being slit, and/or scored and/or crushed.

It can be understood by those skilled in the art that the slits and scores put in the cardboard blank depend on a certain maximum tolerance. For example, if the panels 70–75 of the cross-stringer blank are pre-folded in a manner to be described, and are thicker than they should be due to over tolerance thickness of the cardboard, they will not fit in to the score/crush 76 when they are folded therein by the folding means to be described. Thus, the provision of the qualifying roller(s) in the present invention solves a major problem present in the prior art devices.

To place the scored and crushed areas 76,78, and 80 into the blank, the cross-stringer blank 67 next travels through a scoring/crushing means 133 having a first adjustable scoring/crushing head assembly 134, and a second adjustable scoring /crushing head assembly 135, to be described in more detail hereinafter. First adjustable scoring/crushing head assembly 134, and second adjustable scoring /crushing head assembly 135 are rotatably carried by a shaft which will be adjusted a fixed distance from the rubber blanket 136. The scoring/crushing means 133 will crush and score the cross-stringer blank 67 to provide panels 76,78, and 80, and scores F–K.

If desired, the rubber blanket 136 may be replaced with a steel roller mounted on a shaft. If a steel roller is used, it may have an appropriate profile such that the scoring crushing head assembly 134 and the steel roller (not shown) can be in a male-female relationship.

The cross-stringer blank 67 then progresses to the first slitting means 122 having a first adjustable slitting knife assembly 220 having a total of four slitting knives 230 to slit the cross-stringer blank 67 from the bottom. The slitting knives 230 press against first metal roller 125.

Since the cross-stringer blank 67 must travel along the path of movement defined by lines 114,115, the first slitting knife assembly 220 is adjustable toward and away from the first metal or steel roller 125, which is fixed with regard to the path of movement 114,115. This allows the cardboard to be slit from the bottom, keeping the bottom 67A of the cross-stringer blank 67 in the flat path of movement while making sure that the first slitting knives 230 do not cut into the top sheet (liner) of the cross-stringer blank 67. It can be understood by those skilled in the art that the first adjustable slitting knife assembly 230 may need to be adjusted depending upon the type and caliper of corrugated cardboard being fabricated into the cross-stringer blank 67. For example, AC flute paper is thicker than BC flute paper, and the first slitting means 122 must be adjusted when the paper type is being changed. Slitting knives 230 will have now placed slits A,C,E and L in the cross-stringer blank 167 (FIG. 4).

The cross-stringer blank 67 next encounters a second slitting means 127, including a second adjustable slitting knife assembly 233, to be described further hereinafter, including a pair of slitting blades 230. The slitting knife assembly 223 would normally be driven against a second metal (steel) roller 130. Said second pair of slitting blades 230 would be responsible for slits B and D (FIG. 4) in the cross-stringer blank 67.

The cross-stringer blank 67 then travels over a second lower feed roller 140, which may be driven if desired, having opposite thereof a second adjustable qualifying roller 141. The second qualifying roller 141 may be adjusted lower or the same as first qualifying roller 119, i.e., if the first qualifying roller 119 brings the cross-stringer blank 67 completely within tolerance there is no need for the second qualifying roller 141 to bring the cross-stringer blank 67 within tolerance. However, in some locations without a quality dependable supply of corrugated fiberboard, excessive over tolerance conditions may be encountered, in which case it may be desirable not to have all of the qualifying or bringing within tolerance done by the first qualifying roller 119, but to have that function shared. For example, the first qualifying roller 119 may crush the cross-stringer blank 67 for one half the necessary amount, with the second qualifying roller 141 bringing the cardboard sheet into tolerance before proceeding through the identifying and folding sections.

It can be seen that by virtue of the improvements in the construction of the present invention over the prior art the corrugated paperboard travels in a completely flat and true (paper line) plane of movement through the slitting and scoring means 100, while the corrugated paperboard or fiberboard being used for the cross-stringer blank 67 is brought into tolerance if needed.

It can easily be understood that by adjusting or varying the numbers and/or location of the qualifying rollers (119,141)

the slitting means (122,127) and the scoring and crushing means 133, a wide variety of scoring/crushing and slitting patterns may be provided on the top and/or bottom of a cardboard or fiberboard blank to produce a wide variety of parts. For this reason it can be easily accepted and understood how the stringer blank 82 shown in FIGS. 6 and 7 would be prepared and a description of the slitting and scoring/crushing means, as set up for the stringer blank, is omitted for the purposes of clarity.

Figure 11:
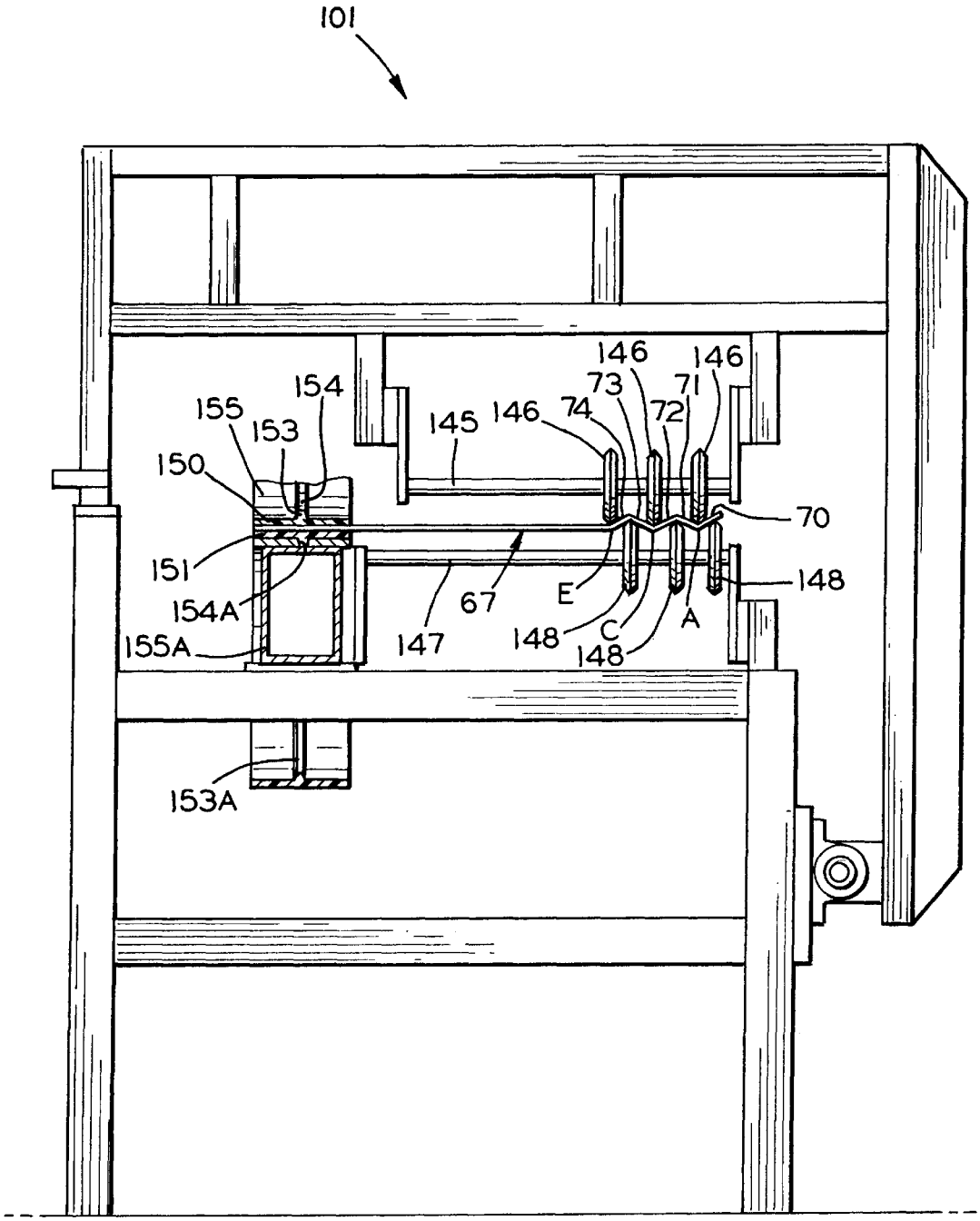
FIG. 11 is a sectional view, taken in the direction of the arrows, along the section line 11—11 of FIG. 8.

Referring now to FIGS. 8 and 11, another major advantage of the present method and apparatus over the prior method and apparatus can be seen. This major improvement resides in the provision of, and the use of identifying rollers.

The identifying means 101 includes a first shaft 145 suitably mounted for rotation, on which are mounted a first plurality of identifying rollers 146. Identifying rollers 146 may be of any desired shape and cross-section. In the preferred embodiment they are of a V-shape. Also, one, or a plurality, of first identifying rollers 146, or none at all, may be used depending upon the particular application of the identifying means 101. As will be shown hereinafter, the identifying means 101A used in connection with the stringer blank is similar to the identifying means 101 used for formation of the cross-stringer.

A second shaft 147 (mounted directly under first shaft 145) carries a second number or plurality of second identifying rollers 148. The first number or plurality of identifying rollers 146 are mounted in a spaced apart parallel relationship on first shaft 145. The second number or plurality of identifying rollers 148 is mounted on second shaft 147. The first plurality of identifying rollers 146 is offset from the second plurality of identifying rollers 148 a predetermined distance so that the tips of the rollers 146,148 correspond with the scores A–E shown in FIGS. 4–5. It can be seen that for different applications, different numbers and arrangements of the first and second identifying rollers (146,148) may be used.

The tips of the first plurality of identifying rollers are interspersed among the tips of the second plurality of identifying rollers in an overlapping relationship (i.e., the tips of first identifying rollers 146 are below the tips of the second identifying rollers 148) to cause the panels A–E to fold slightly with respect to an adjacent panel and thus identify where the folds are for the remainder of the apparatus.

At this point in the apparatus the cross-stringer blank 67 is no longer being driven by the first and second feed rollers 118,140 used in the slitting and scoring/crushing means 100, but is being driven between an upper conveyor belt 150 and a lower conveyor belt 151 supported and driven by means known in the art. The upper conveyor belt 150 has a first protuberance 153 which rides in a complimentary shaped recess 154 in the belt supporting means 155. The lower conveyor belt 151 also has a protuberance 153A riding in recess 154A in lower belt supporting means 155A.

Figure 12:
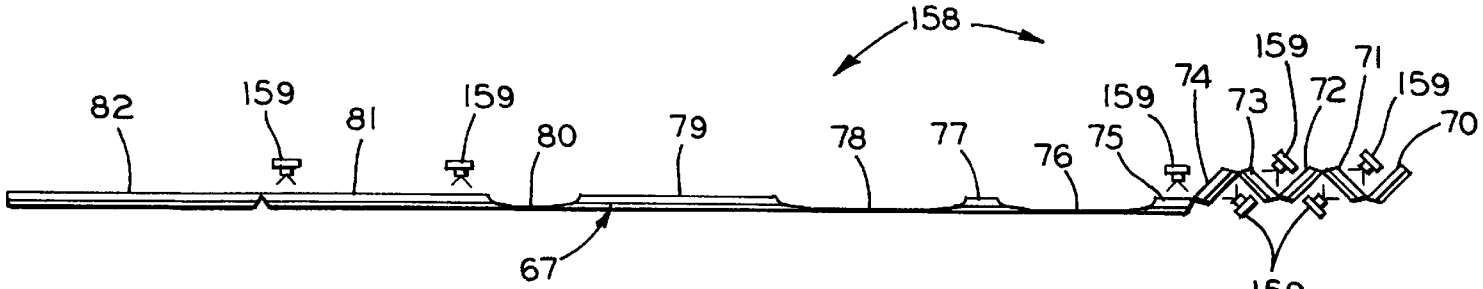
FIG. 12 is a sectional view, taken in the direction of the arrows, along the section line 12—12 of FIG. 8.

Continuing on its path through the apparatus of the present invention, after passing through the identifying means 101, the cross-stringer blank 67 will pass under first glue station 158 (FIG. 12) where cold glue will be applied as shown in two locations to the top of panel 81 and in one location to the tops of panels 71,73, and 75, and also to the bottom of panels 71 and 74.

The method used to apply the glue and the apparatus may be such as disclosed in the co-pending Provisional patent application Ser. No. 60/045,920 filed May 7, 1997 in the names of Ken N. Winebarger and Stanley M. Lee, entitled "Automotive Glue Head Purging/Cleaning System", or may be one of the glue application systems known in the prior art. Glue, adhesive, or bonding agents may be applied.

Referring to FIGS. 45–48, after passing underneath the first gluing station 158, the cross-stringer blank 67 proceeds to the cross-stringer gathering and/or prefolding device or section 102. At the beginning of the gathering section 102, the cross-stringer blank 67 will have the cross section shown in FIG. 12, and will be driven by the upper transfer belt(s) 275 and lower transfer belt(s) 276. As the cross stringer blank 67 travels in the direction of the arrow shown in FIG. 45. the panel 70 will encounter inwardly curving, curvilinear, guide rail 277, which is mounted to, or adjacent, a first low friction surface 278. The first low friction surface is preferably made of the UHMV material described above, but any suitable low friction material can be used. The first low friction surface 278 may run parallel to and/or adjacent one of the lower transfer belt(s) 276.

On the other side of lower transfer belt(s) 276 is an open area identified by the numeral 279. Although the open area 279 is used in the preferred embodiment, another low friction surface, or other type surface may be provided. Mounted in the open area 278 is an upwardly inclined, inwardly curving, curvilinear lifting rail 280. The upwardly inclined, inwardly curving, curvilinear lifting rail 280 is preferably made of a low friction material such as UHMV (Ultra High Molecular Volume), but may be made of other materials.

At approximately the same time the panel 70 (FIG. 12) encounters the curvilinear guide rail 277, and the panel 70, together with panels 71–74, are being gathered inwardly toward the lower transfer belt 276, the panel 82 will encounter the curvilinear lifting rail 280 and be lifted upwardly from its' horizontal position to a vertical position as the cross-stringer blank 67 nears the end of the cross stringer gathering section or device 102.

Figure 13:
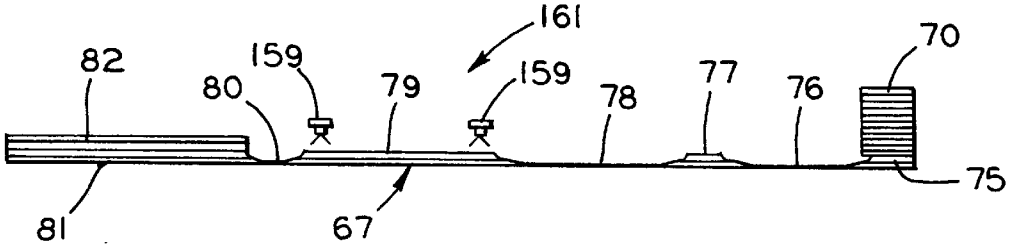
FIG. 13 is a sectional view, taken in the direction of the arrows, along the section line 13—13 of FIG. 8.

The momentum imparted to the panel 82 should be sufficient, in the preferred embodiment, so that the panel 82, after being lifted to its vertical position, continues to travel about it's hinged connection with panel 81, and actually fold over on top of panel 81, as shown in FIG. 13 just before the blank approaches roller(s) 281.

Likewise, the panels 70–74, after they are fully gathered together by the curvilinear guide rail 206, should continue to fold over on to the top of panel 75, as shown in FIG. 13.

FIG. 13 shows the cross section of the cross stringer blank 67 after it has passed through the cross stringer gathering device or section 102, and just before it enters second glue station 161. It can be easily understood that if a different sheet material were being folded, the guide rail 206, the lifting rail 209, and any other components, may be easily rearranged, as desired.

Figure 15:
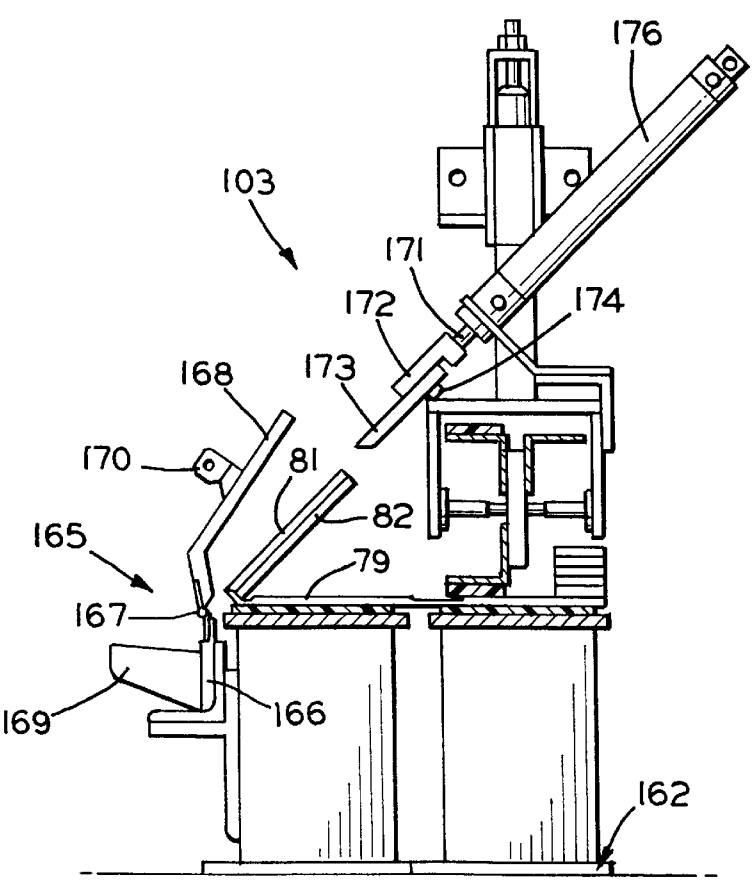
FIG. 15 is a sectional view, taken in the direction of the arrows, along the section line 15—15 of FIG. 8.
Figure 14:
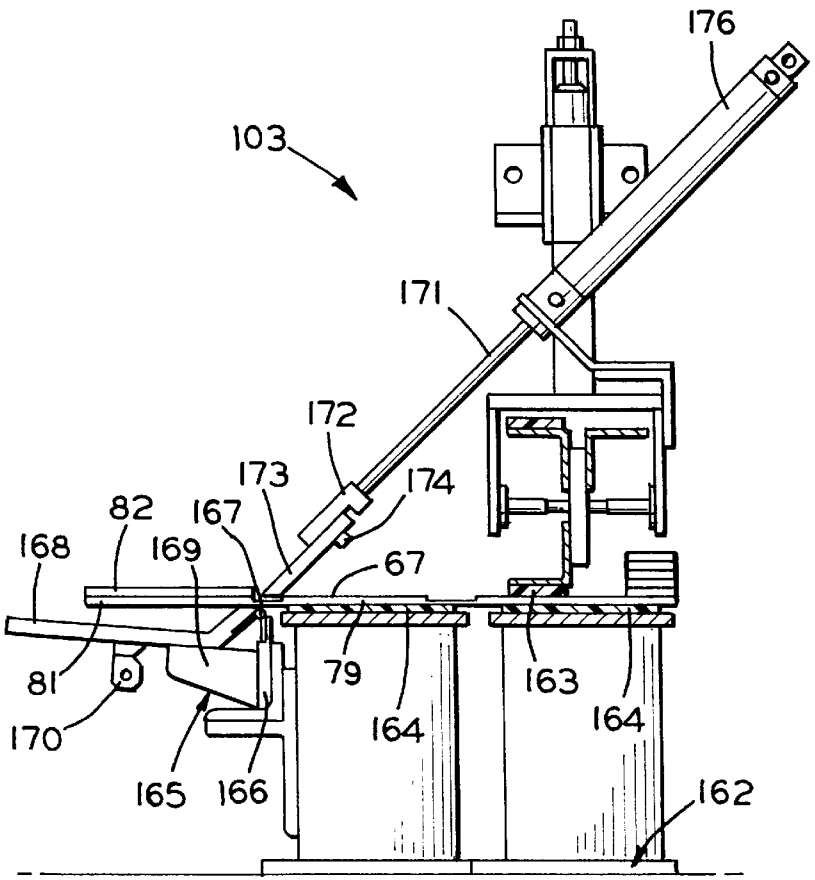
FIG. 14 is a sectional view, taken in the direction of the arrows, along the section line 14—14 of FIG. 8.

After the cross-stringer blank 67 exits from the second glue station 161, it will proceed through the first cross-stringer folding means 103 illustrated in more detail in FIGS. 14 and 15. First cross-stringer folding means 103 has a suitable base portion 162 having an upper conveyor belt or belts 163 and a pair of lower conveyor belts 164 driving the cross-stringer blank 67 in its partially formed configuration through the first cross-stringer folding means.

Attached to the base is a single hinged folding member 165 having a mounting portion 166 attached to the base, a hinge member 167, and an angled member 168. A bracket 169 helps support the angled member 168 in its opened position. A fluid operated cylinder (not shown), well known in the art, is operably attached to cylinder bracket 170 (and preferably base 162) to rotate the angled member from its open position shown in FIG. 14 to a 135 degree rotated position shown in FIG. 15.

Since cross-stringers 61 are required in widely varying lengths, depending on the application, it is usually desirable to split the angled member 168 into two or more members or sections, with the attendant apparatus to operate and control each section.

In the preferred embodiment illustrated, the single hinged folding member 165 has an upstream section which is 50 inches in length, and a downstream section which is 25 inches in length. When the cross-stringer blank is over fifty inches in length, the upstream and downstream sections will operate in unison, and usually not until the blank has reached substantially the end of the downstream section. When the cross-stringer blank is less than 50 inches in length, only the upstream section is used. By being able to use one, shorter, section for shorter cross-stringers, faster cycle times can be achieved. It can be understood that the exact dimensions and usage will vary, depending on the application.

A second fluid operated cylinder 176, having a shaft 171, is provided. While the cross-stringer blank 67 is entering the first cross-stringer folding means 103, the shaft 171 of second fluid operated cylinder 176 is extended so that the adjustable arm 173 attached to the adapter 172 by fastening means 174 bears against the cross-stringer blank 67 so that it will not lift until the angled member 168 starts folding panels 81 and 82 of the cross-stringer blank 67. As the angled member 168 approaches the 135 degree position, the second fluid operated cylinder 176 is operated to retract shaft 171 and thus, adjustable arm 173, so it can clear the panels 81 and 82. These panels (81,82) make contact with panel 79 when they are passed from this folding station to the upper drive belt. Since glue was applied at the second glue station 161 this portion of the cross-stringer being formed will be setting up in the glued position while under pressure of the drive belt.

Figure 16:
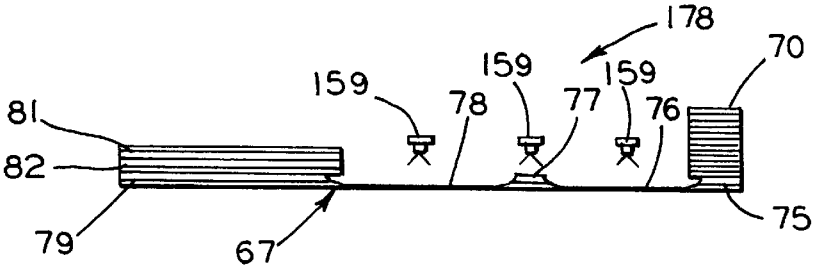
FIG. 16 is a sectional view, taken in the direction of the arrows, along the section line 16—16 of FIG. 8.

Immediately after this operation the cross-stringer blank 79 proceeds to the third glueing station 178 (FIG. 16) wherein additional cold glue heads 159 apply additional cold glue, or other desired adhesives, to panels 76,77 and 78.

Figure 17:
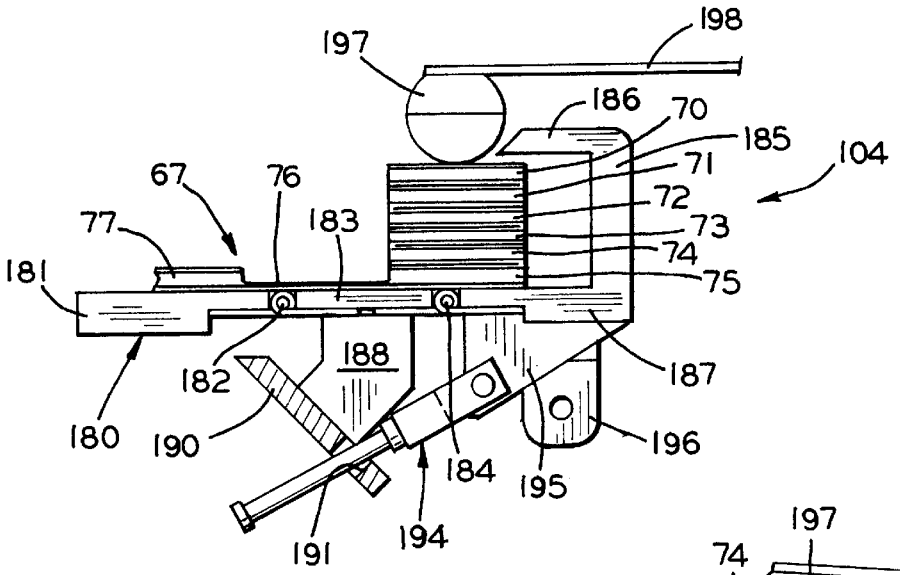
FIG. 17 is a sectional view, taken in the direction of the arrows, along the section line 17—17 of FIG. 8.
Figure 18:
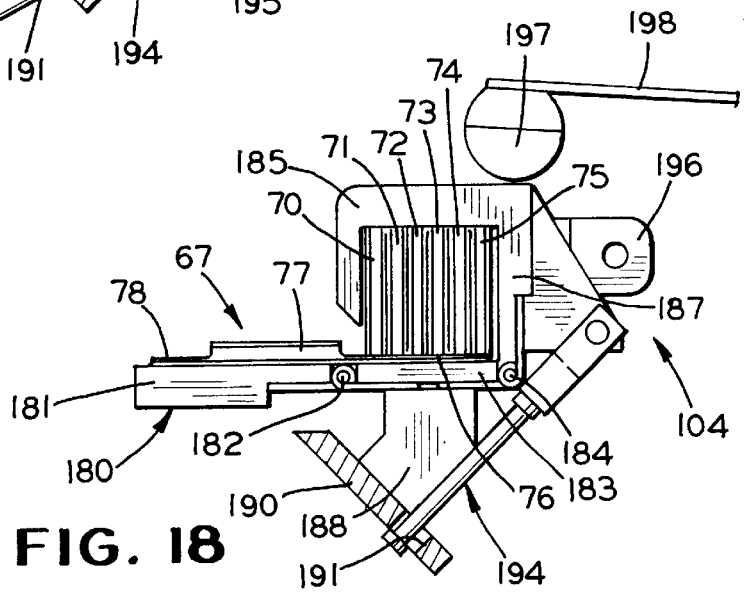
FIG. 18 is a sectional view, taken in the direction of the arrows, along the section line 18—18 of FIG. 8.
Figure 19:
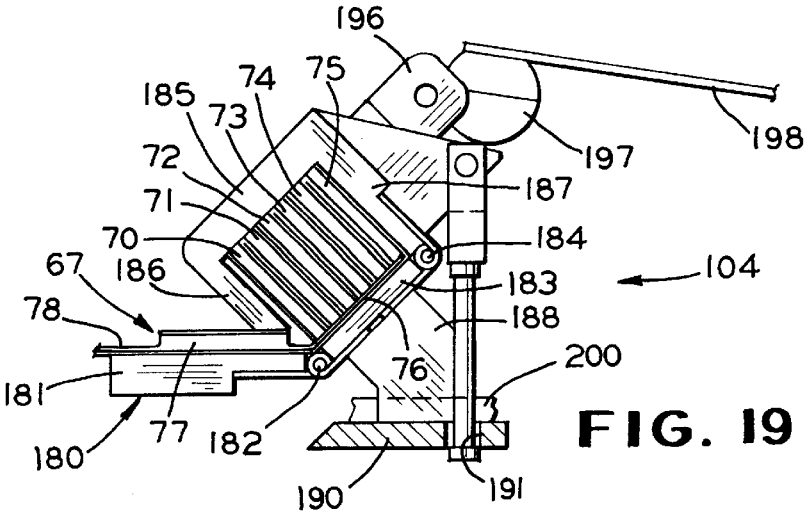
FIG. 19 is a sectional view, taken in the direction of the arrows, along the section line 19—19 of FIG. 8.
Figure 20:
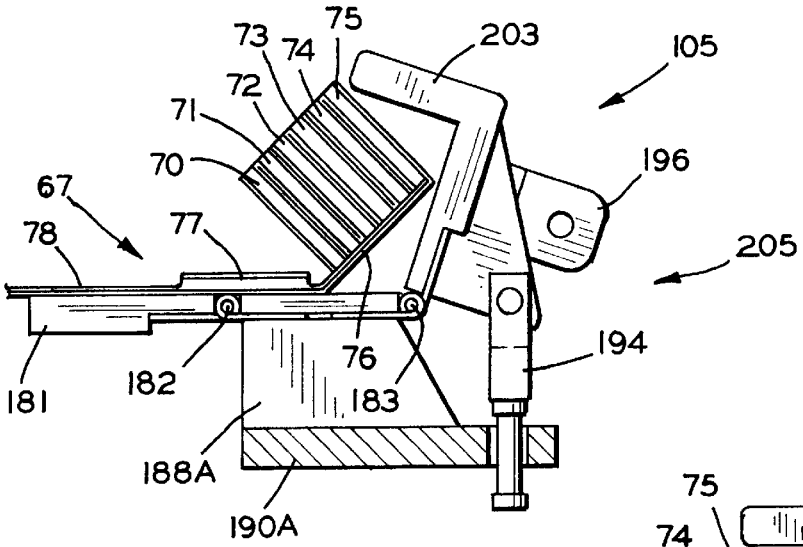
FIG. 20 is a sectional view, taken in the direction of the arrows, along the section line 20—20 of FIG. 8.

After passing under third glue station 178 the cross-stringer blank travels into second cross-stringer folding means 104 illustrated in FIGS. 17,18 and 19. The operations illustrated in FIG. 17, 18 and 19 take place each time a partially formed cross-stringer 61 or cross-stringer blank 67 enters the second cross-stringer folding means. Second cross-stringer folding means includes a double hinged folding means 180, including a first hinge portion 181, a first hinge 182, a second hinge portion 183, a second hinge 184, and a third substantially C-shaped hinge portion 185, with the "C" facing backwards. It can be understood that if third hinge portion 185 were viewed from the opposite direction, the "C" shape would no longer appear to be facing backwards. As before, depending on the application, the double hinged folding means or member 180 may be split into two or more portions or sections, depending on the application.

It can be seen that the upper portion 186 of the C-shaped portion 185 is slightly shorter than the lower portion 187. Attached to the second hinged portion 183 is a stop member 188 having angled arm portion 189, and a stop portion 190, for purposes to be hereinafter described. An opening 191 is provided in stop number 190. An adjustable stop means 194 is rotatably mounted to stop bracket 195, while a fluid operated cylinder, well known in the art (not shown) is connected to cylinder mounting bracket 196.

As the cross-stringer blank 67 continues to be propelled by suitable conveyer belts (not shown), the partially folded cross-stringer blank 67 will enter the second cross-stringer folding means 104 and, in doing so, will pass on to the double hinged folding means 180 illustrated in FIG. 17. Initially, the double hinged folding means 180 is in its open position as illustrated therein. The portion of the cross-stringer blank 67 consisting of panels 70–75 is ready to be folded into the scored/crushed area 76. The portion of the cross-stringer consisting of said panels 70–75 is partially enclosed at this point by the third, substantially backward C-shaped portion 185 of the double hinged folding means 180, and pressure is maintained thereon by a UHMV rod 197 mounted to a spring steel or other suitable member 198. As the partially formed cross-stringer blank 67 advances within the second cross-stringer folding means 104, the fluid cylinder (not shown) attached to the fluid cylinder mounting bracket 196 (and preferably base 162) starts to extend, causing the mounting bracket 196, and thus third substantially backward C-shaped portion 185 to also rotate.

C-shaped portion 185 is designed to rotate 90 degrees before the adjustable stop means 194 engages the stop 190 of stop member 188. Adjustable stop means 194, depending on the application, may permit up to 180° of rotation, if desired. At this time C-shaped portion 185 of double hinge folding means 180 almost completely encloses panels 70–75 of the partially folded cross-stringer blank 67.

At this point the fluid cylinder attached to mounting bracket 196 continues to rotate, which causes adjustable stop means 194, which has engaged stop 190 of stop member 188, to cause the second hinge portion 183 of the second cross-stringer folding means to rotate until the stop 190 engages a second stop 200 (omitted for clarity from FIGS. 17 and 18). This allows the upper portion 186 of the by now rotated substantially backward C-shaped third portion 185 to clear the remainder of the cross-stringer blank 67, which it would otherwise engage and cause binding in the operation of the apparatus of the present invention.

Figure 21:
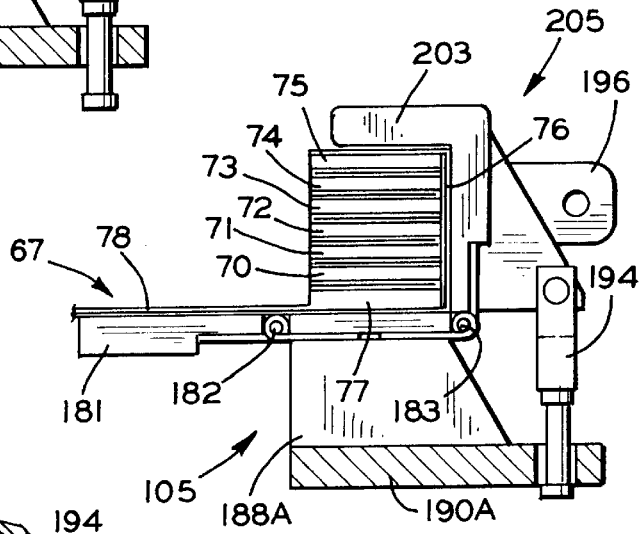
FIG. 21 is a sectional view, taken in the direction of the arrows, along the section line 21—21 of FIG. 8.
Figure 22:
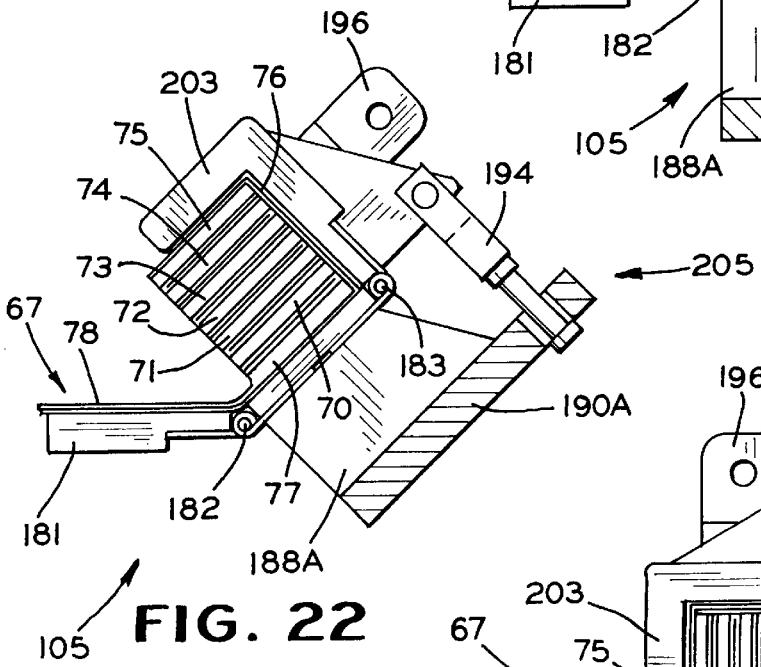
FIG. 22 is a sectional view, taken in the direction of the arrows, along the section line 22—22 of FIG. 8.
Figure 23:
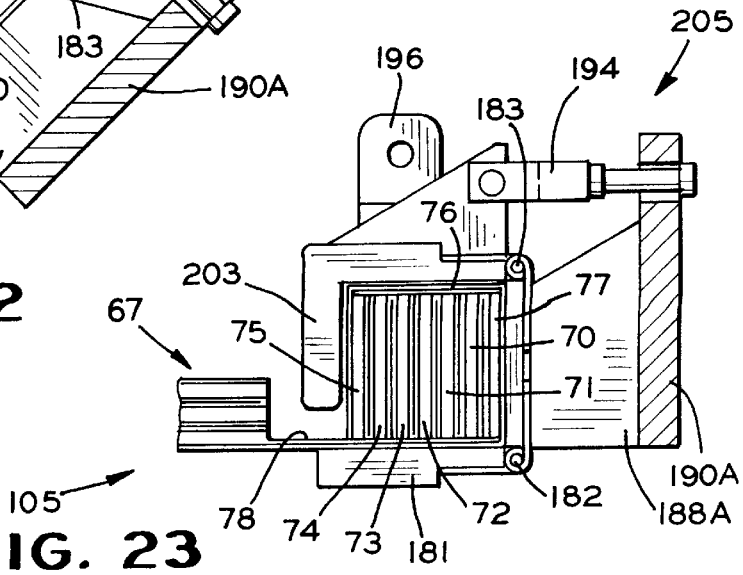
FIG. 23 is a sectional view, taken in the direction of the arrows, along the section line 23—23 of FIG. 8.
Figure 24:
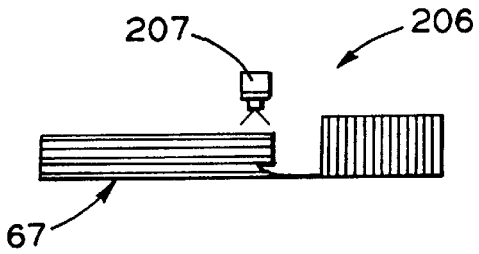
FIG. 24 is a sectional view, taken in the direction of the arrows, along the section line 24—24 of FIG. 8.

With the cross-stringer blank 67 still traveling in a longitudinal path in a flat plane of movement, the blank 67 now leaves the second cross-stringer folding means and enters the third cross-stringer folding means 105 (FIGS. 21,22,23).

The construction of the third cross-stringer folding means 105 is substantially similar to the construction of the second cross-stringer folding means 104 except that third substantially C-shaped portion 185 of the second cross-stringer folding means has been replaced by L-shaped portion 203. For ease of understanding this will be referred to as modified double hinged folding means 205 in FIGS. 21–23. As before, the modified double hinged folding means can be split into two or more sections, depending on the application.

It can also be seen that the shape, but not the function of stop member 188 and stop 190 have changed. For ease of understanding these have been renumbered 188A and 190A.

As the by now almost fully formed cross-stringer blank 67 proceeds through the third cross-stringer folding means 105, panels 70–75 are folded onto the top of panel 77. An additional 90 degrees of rotation folds panels 70–77 over onto a portion of panel 78 as the blank 67 completes its travel through the third cross stringer folding means 105.

The cross-stringer blank 67 then leaves the third cross-stringer folding means 105, and enters the fourth cross-stringer folding means 106. It can be seen that the fourth cross-stringer folding means 106 is substantially identical to the third cross-stringer folding means 105. As before, the forth cross stringer means can be split into two or more sections, depending on the application.

Figure 25:
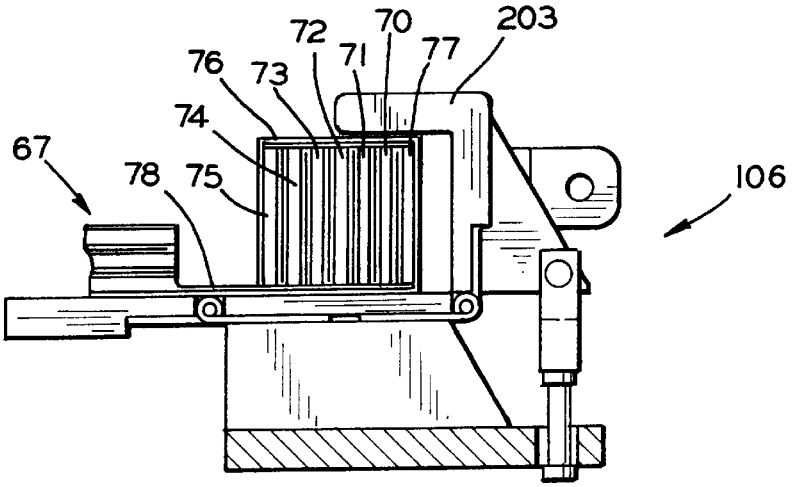
FIG. 25 is a sectional view, taken in the direction of the arrows, along the section line 25—25 of FIG. 8.
Figure 26:
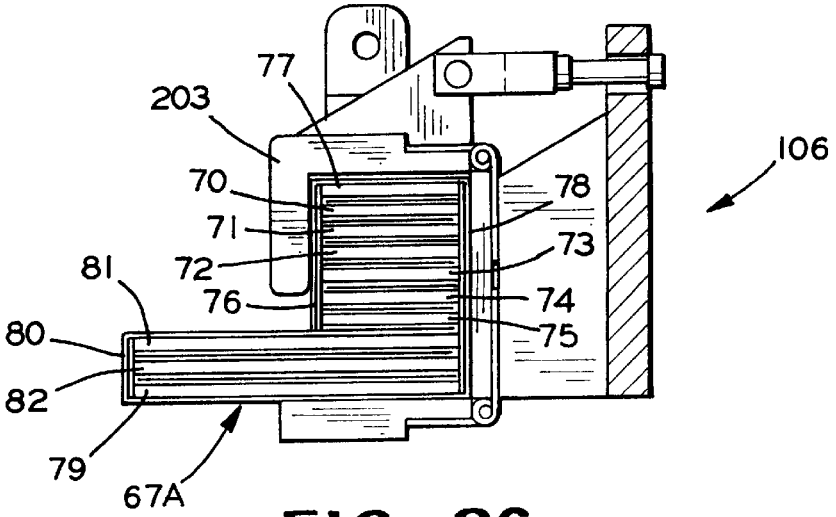
FIG. 26 is a sectional view, taken in the direction of the arrows, along the section line 26—26 of FIG. 8.

While passing from the third cross-stringer folding means 105 into the fourth cross-stringer folding means 106, the cross-stringer blank 67 passes underneath a hot glue head 207 to place a bead of hot melt glue or other suitable adhesive at a pre-determined position on panel 81 to glue panels 70–75 and 77 to the top of panel 81 when the fold shown taking place in FIGS. 25 and 26 is completed to form the completed cross-stringer 61.

Figure 6:
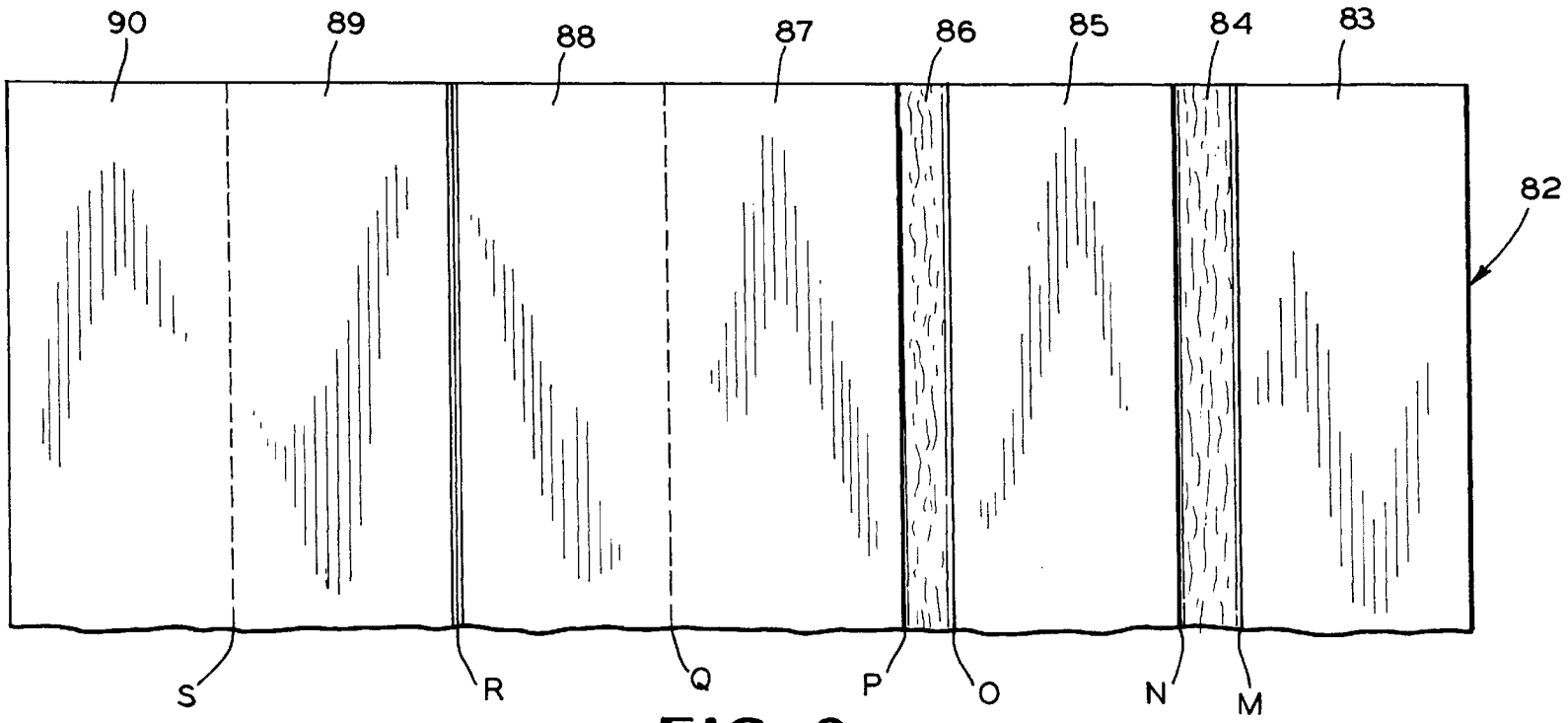
FIG. 6 is a partial plan view of a corrugated paperboard or fiberboard blank before being folded by the apparatus of the present invention into the stringer shown in FIGS. 1 and 3.
Figure 7:
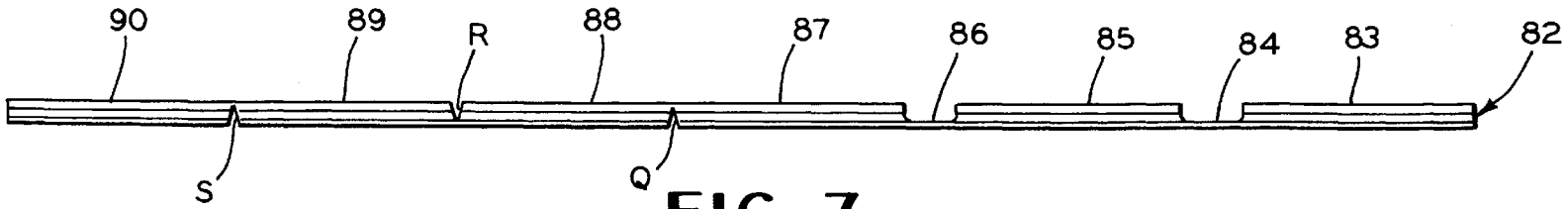
FIG. 7 is an elevational view of the construction shown in FIG. 6.

Having followed the formation of the completed cross-stringer 61, it can now be understood how the apparatus of the present invention can be easily modified to run other parts made of folded fiberboard or cardboard, such as stringer 62 or rectangular cardboard member made from the stringer blank illustrated FIG. 6 and 7.

Referring to FIG. 9 the apparatus of the present invention is shown easily modified to form the cross-stringer blank 82 into a rectangular folded member. From the previous explanation it can easily be seen how the slitting and scoring/crushing assembly or means 100 can be set up to slit and score/crush the stringer blank 82. The modified slitting and scoring/crushing means is illustrated as 10A.

Figure 27:
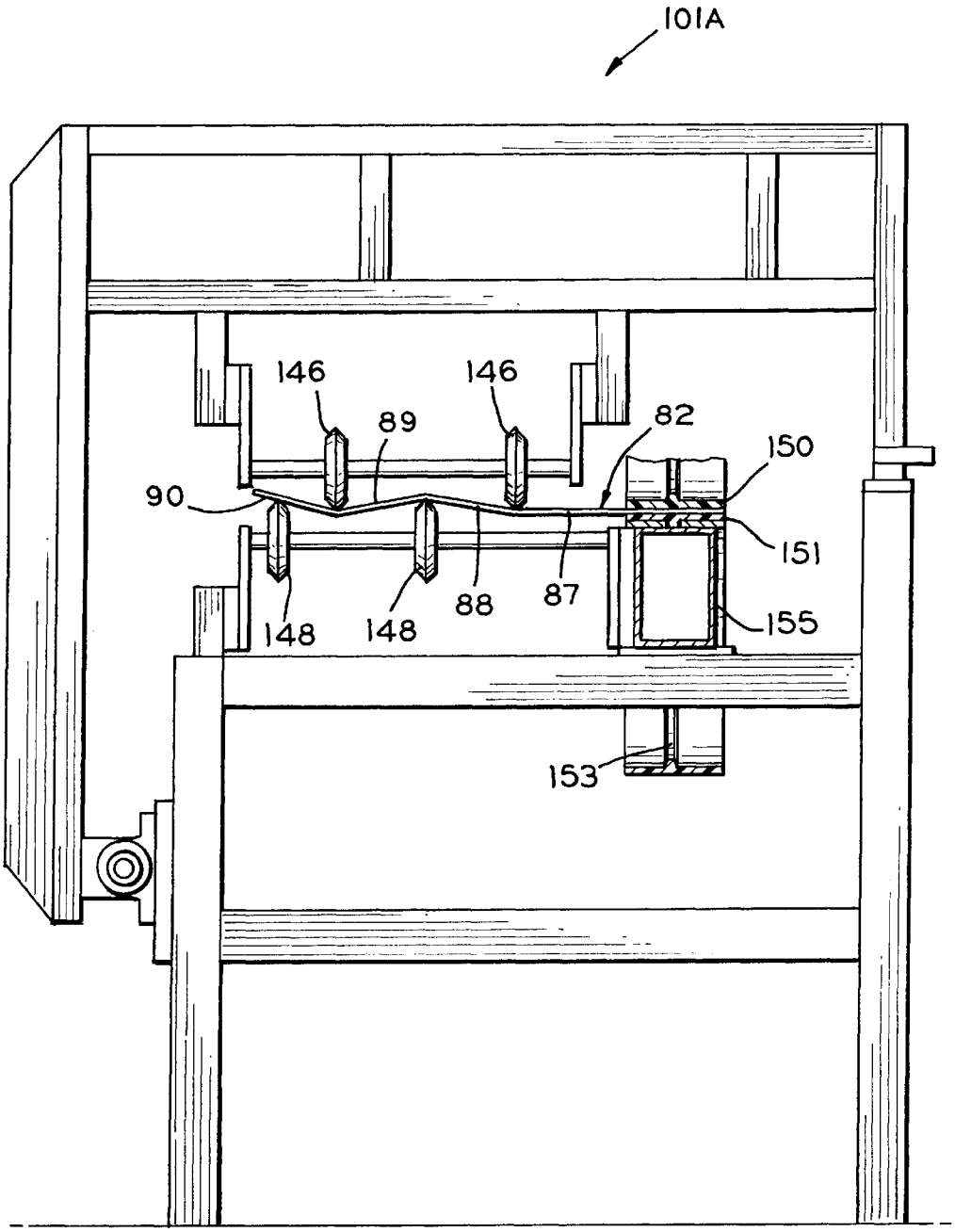
FIG. 27 is a sectional view, taken in the direction of the arrows, along the section line 27—27 of FIG. 9.

Referring to FIG. 27, there is shown a modified identifying means 101A very similar to the identifying means 101 shown in FIG. 11. Again there is shown an upper conveyor belt 150 and a lower conveyor belt 151 driving the stringer blank 82. There is a first plurality of identifying rollers 146 on the top side of the stringer blank and a second plurality of identifying rollers 148 on the bottom of the stringer blank 82. It can be understood that any number of identifying rollers could be used on the top or bottom of the blank 82 depending upon the part being formed. It is even possible that no identifying rollers would be needed in some applications.

Figure 28:
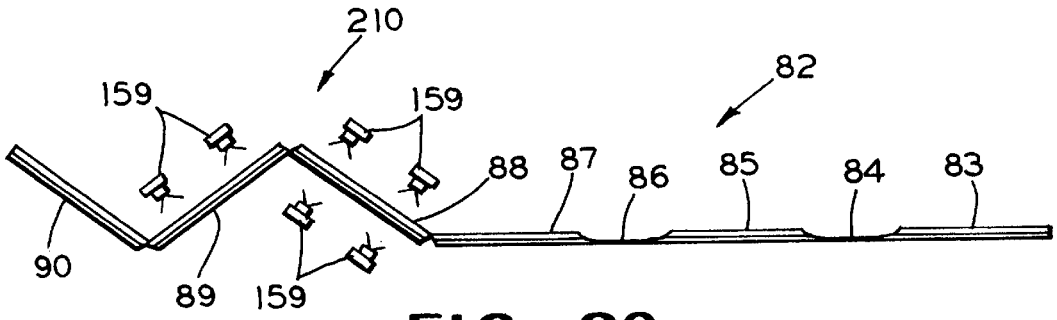
FIG. 28 is a sectional view, taken in the direction of the arrows, along the section line 28—28 of FIG. 9.

After passing through the modified identifying means 101A, the stringer blank 82 passes under first stringer glueing station 210 (FIG. 28) where six cold glue heads 159 apply cold glue or other suitable adhesive or bonding material to the top of stringer panel 89, and to both sides of stringer panel 88.

Referring to FIGS. 49–52, after passing through first stringer glueing station 210. the stringer blank will pass through stringer gathering and pre-folding device or section 102A. At the beginning of the stringer gathering section 102A, the stringer blank 82 will have the cross-section shown in FIG. 28,and will be driven by the upper transfer belt(s) 285, and the lower transfer belt(s) 286. As the stringer blank 82 travels in the direction of the arrow shown in FIG. 49, the panel 90 will encounter a flat, curvilinear rail or bar 287. The flat, curvilinear rail or bar 287 may be parallel or adjacent to a second low friction surface 288. It is preferred that second low friction surface 288 be made of UHMV, but other surfaces may be provided.

As the panels 88–90 (FIG. 52) continue to be pushed in the direction of the arrow, the elevation of the panel 90 increases. To maintain paper control, a curvilinear, upwardly inclined, inverted L-shaped channel 290 is provided. The inverted channel 290 is preferably elevated with respect to the second low friction surface 288, and the flat rail or bar 287. The slope of the inverted channel 290 preferably closely matches the rate of increase of the elevation of the panel 90. The panel 90 is controlled while the stringer blank travels along the path of movement through the stringer gathering section 102A.

Figure 29:
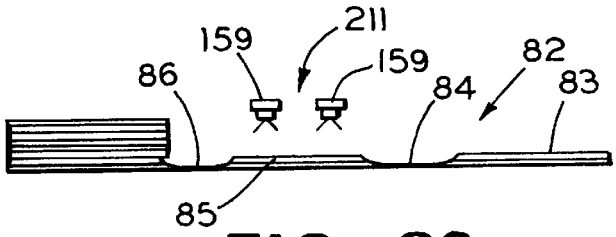
FIG. 29 is a sectional view, taken in the direction of the arrows, along the section line 29—29 of FIG. 9.

The panel 90, as it completes its' travel through the stringer gathering section 102A will contact panel 293. The panel 293 is sharply angled inwardly and may be designed to impart extra momentum to the panel 90, and thus panels 88,89. The extra momentum, in the preferred embodiment, should be sufficient so that the panels 88–90, as they are lifted to their vertical position, continue to travel about their hinged connection with panel 87, and actually fold over on to the top of panel 87, as shown in FIG. 29, before passing under rollers 294.

After passing out of stringer gathering means 102A, the stringer blank 82 will pass under second cross-stringer glueing station 211 (FIG. 29), where two glue heads 159 apply additional cold glue or other adhesive or bonding agent to the top of panel 85. The momentum created by gathering means 102B will cause panels 88,89 and 90 to continue to rotate and fall over onto the top of panel 87 after the glue is applied in the first cross-stringer glueing station.

Figure 30:
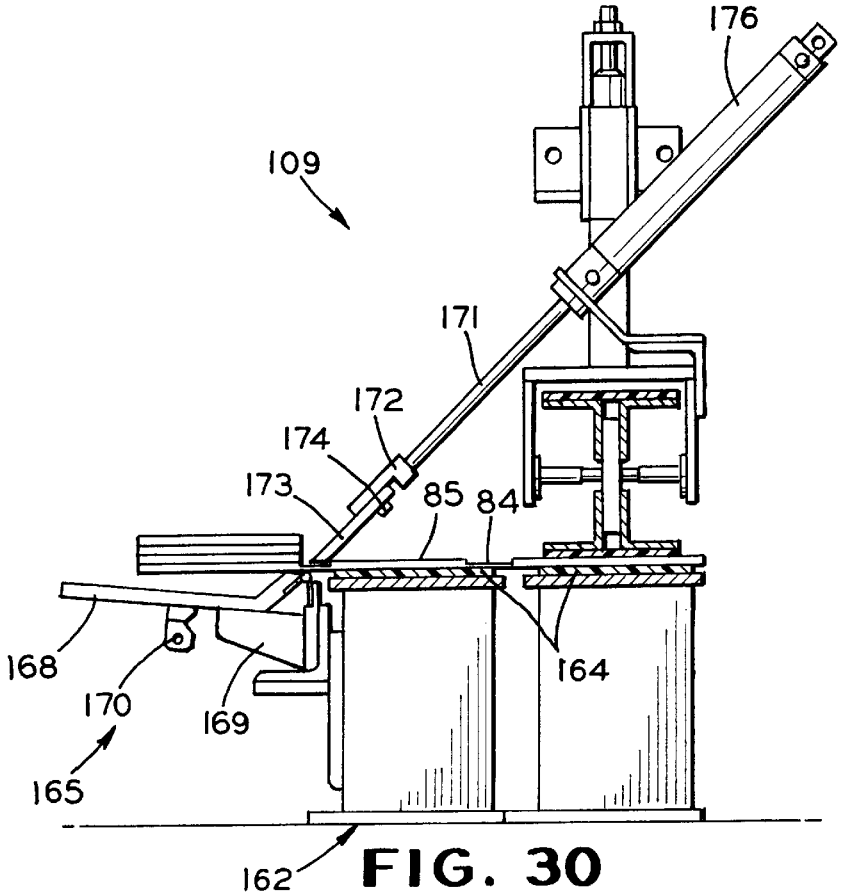
FIG. 30 is a sectional view, taken in the direction of the arrows, along the section line 30—30 of FIG. 9.
Figure 31:
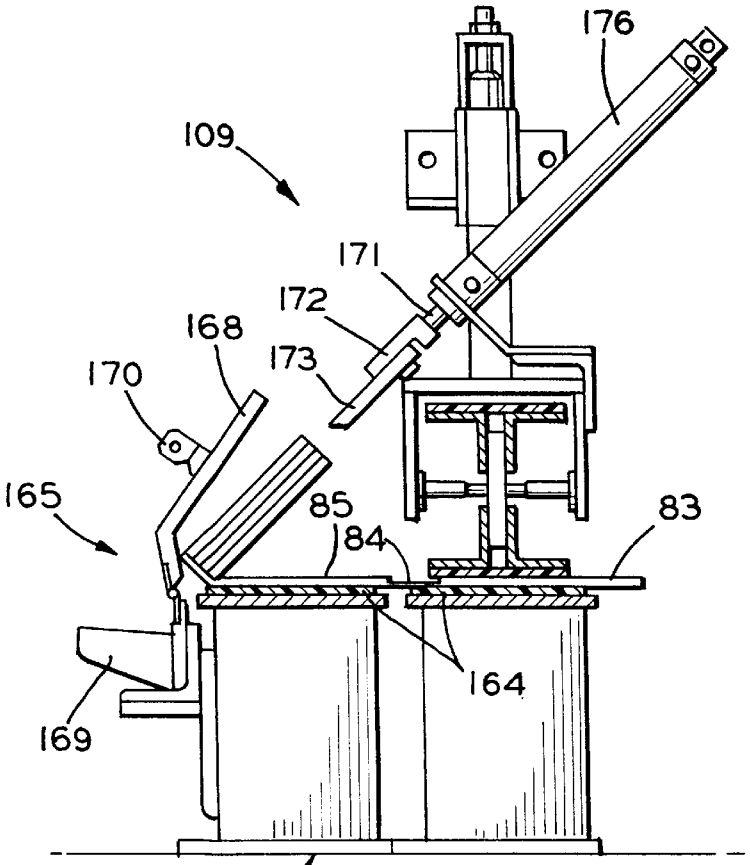
FIG. 31 is a sectional view, taken in the direction of the arrows, along the section line 31—31 of FIG. 9.

After exiting the glueing station, the stringer blank 82 enters first stringer folding means 109 (FIGS. 30,31), which is substantially identical to the first cross-stringer folding means 103 shown in FIG. 14. Identical part numbers have been applied thereto.

Since the stringers being formed are also required in a wide variety of lengths, as with the angled member 168 forming a part of the first cross-stringer folding means 103, the angled member 168 forming a portion of the first stringer folding means 109 may be divided into two or more portions, such as an upstream portion and a downstream portion, with the attendant apparatus to operate each portion.

In the preferred embodiment illustrated, the upstream portion of the angled member 168 forming a portion of the first stringer folding means 109 is again fifty inches in length, while the downstream portion of angled member 168 forming a portion of the first stringer folding means 109 is twenty five inches in length. These dimensions may vary, depending on the application. As before, the first portion and the second portion will operate in unison if the stringer being formed is over fifty inches in length. If the stringer being formed is less than fifty inches in length, only the first portion will be used.

In the first stringer folding means 109, as the stringer blank 82 travels from section line 30—30 to section line 31—31 panels 87–90 are folded over onto the top of panel 85, as the angled member 168 rotates through 135°.

Figure 32:
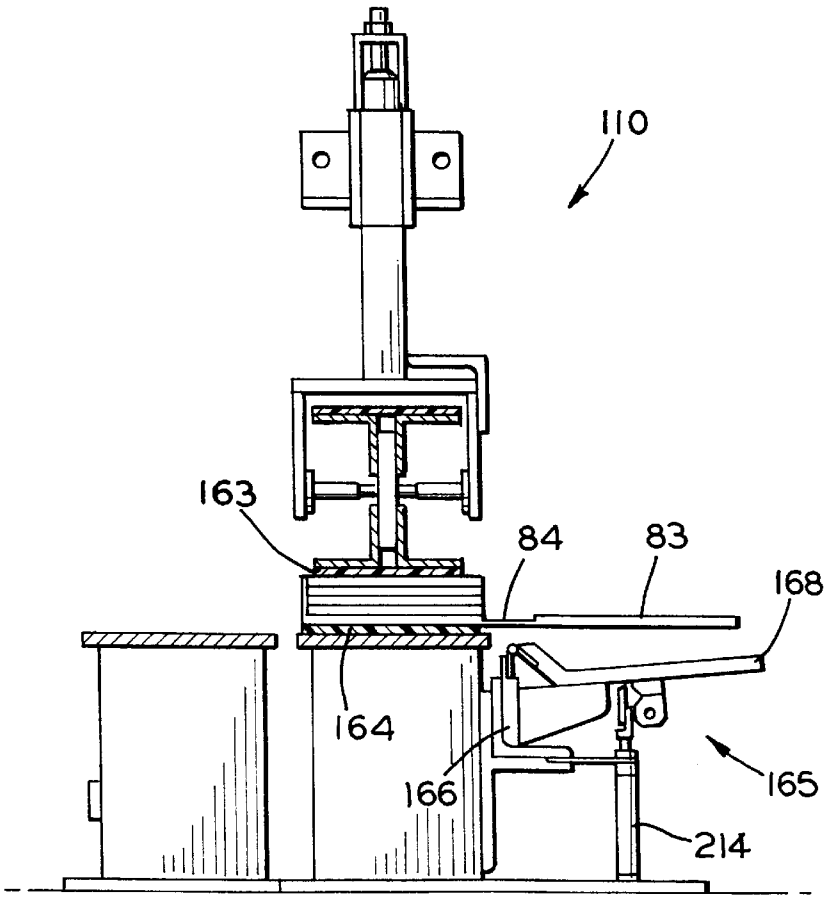
FIG. 32 is a sectional view, taken in the direction of the arrows, along the section line 32—32 of FIG. 9.
Figure 33:
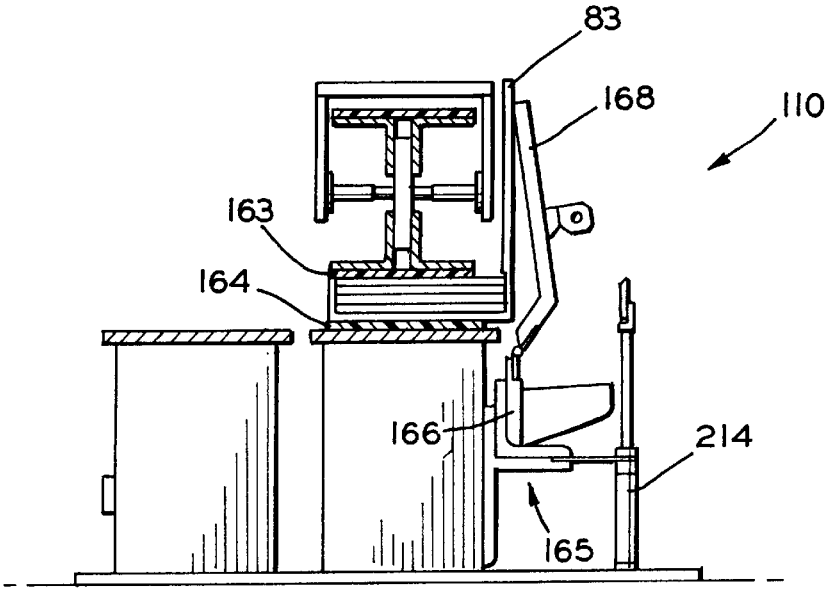
FIG. 33 is a sectional view, taken in the direction of the arrows, along the section line 33—33 of FIG. 9.

After passing through the first stringer folding means 109, the stringer blank passes into the second stringer folding means 110 illustrated in FIGS. 32 and 33. The second stringer folding means 110 is very similar to the first stringer folding means 109, which is substantially similar to the first cross-stringer folding means 103. It can be seen that a single hinged folding means is used to fold the cross-stringer blank 82 while an upper conveyor belt 163 and a lower conveyor belt 164 drive the stringer blank through the folding means. The angled member 168 serves to fold panel 83 ninety degrees. A damper 214 is added to the second stringer folding means for smoothness of operation. As with the first stringer folding means 109, the second stringer folding means 110 may be split into two or more sections, depending on the application.

Figure 34:
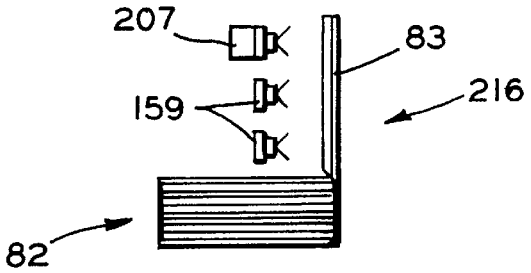
FIG. 34 is a sectional view, taken in the direction of the arrows, along the section line 34—34 of FIG. 9.
Figure 35:
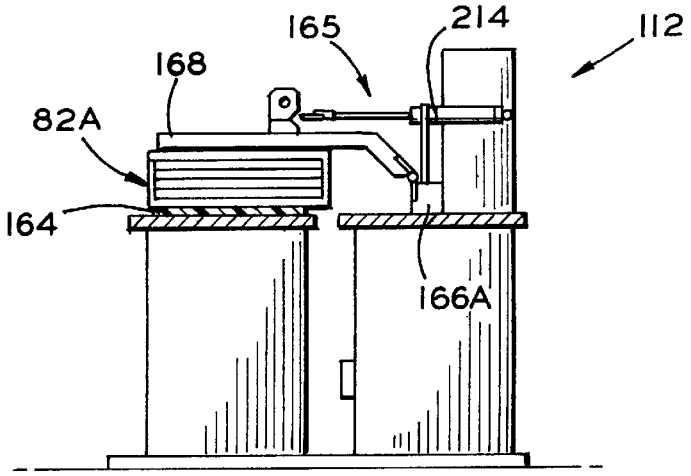
FIG. 35 is a sectional view, taken in the direction of the arrows, along the section line 35—35 of FIG. 9.

After exiting second stringer folding means 110 the stringer blank will pass through third stringer glueing station 216 (FIG. 34) where a combination of cold glue heads 159 and hot glue head 207 will apply a combination of hot and cold glues, adhesives or suitable bonding agents to the underside of panel 83 of the by now almost fully formed stringer blank 82. After passing through glue station 216 (FIG. 35), stringer blank 82 will pass through third stringer folding means 112 (FIG. 35). The construction of third stringer folding means can be seen to be substantially identical, to the construction of the second stringer folding means, except that the orientation of the angled member 168 in its operative position has been rotated 90 degrees, and the mounting portion 166A of the single hinged folding means 165 has been modified accordingly. As before, the third stringer folding means 112 may be divided into two or more sections, depending on the application.

It should be understood that the now fully formed rectangular member or stringer 62 now passes through a second or stringer compression station 111, substantially similar to the first or cross-stringer compression station 107 where a top and a bottom belt will keep the rectangular member 82A under compression until the glue sets, at which time the stringer 82A is complete. As with the cross-stringer compression station 107, the stringer compression station 111 is known in the art, and is not shown in detail herein.

The ease of adapting the apparatus of the present invention for slitting various parts to be made of folded fiberboard or corrugated paperboard material can be seen by reference to FIGS. 36–40, showing the fully adjustable slitting blade assembly of the present invention. Second adjustable slitting knife assembly 233, is illustrated by way of example. Hub 221 is mounted to a shaft 222. The flange 223 of hub 221 has plurality of threaded openings therein to accept a plurality of threaded fasteners 225. Outer flange 226 has a plurality of apertures 227 complementary in position to the threaded openings 224. It can be seen that the threaded fasteners 225 may be passed through the spaced apertures 227 in the outer flange 226 to attach it to the flange 223 of hub 221. In like manner any number and width of spacers 229 may be provided having the spaced apertures 227 to make the second adjustable slitting knife assembly 233 as wide or as narrow as desired.

One, or a plurality, of split slitting blades 230 having upper half or portion 231, and lower half or portion 232, may be used. Each of said upper half or portion 231 and lower half or portion 232 has the appropriate number of spaced apertures 227 to be engaged by the threaded fastener when put between the outer flange 226 and/or the spacer 229 and/or the flange 224 of the hub 221. It can be seen that since the hub 221 is mounted to keyed shaft 222, and the spacer 229 and the outer flange 226 are mounted to the hub 221 the threaded fasteners 225 may easily be removed without disassembling the entire slitter knife assembly 220, and new slitting blades 230 may simply be installed quickly and easily with no disassembly, and virtually no down time of the machine. The wide versatility of this arrangement can be seen by referring to FIGS. 37–40.

Figure 37:
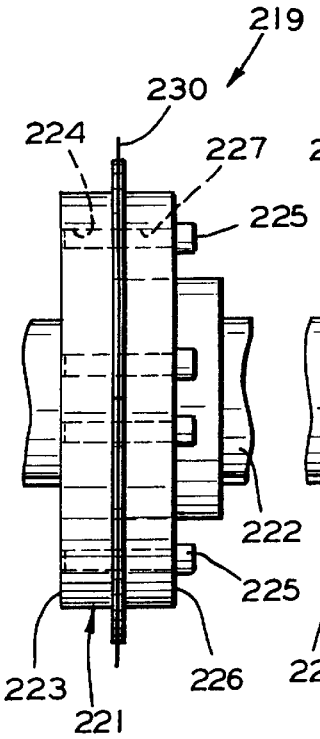
FIG. 37 is a view similar in part to FIG. 36, but showing the slitting means set up to hold a single slitting blade.

FIG. 37 shows an adjustable slitting knife assembly 219 having a single slitting blade 230 mounted between flange 223 and outer flange 226.

Figure 38:
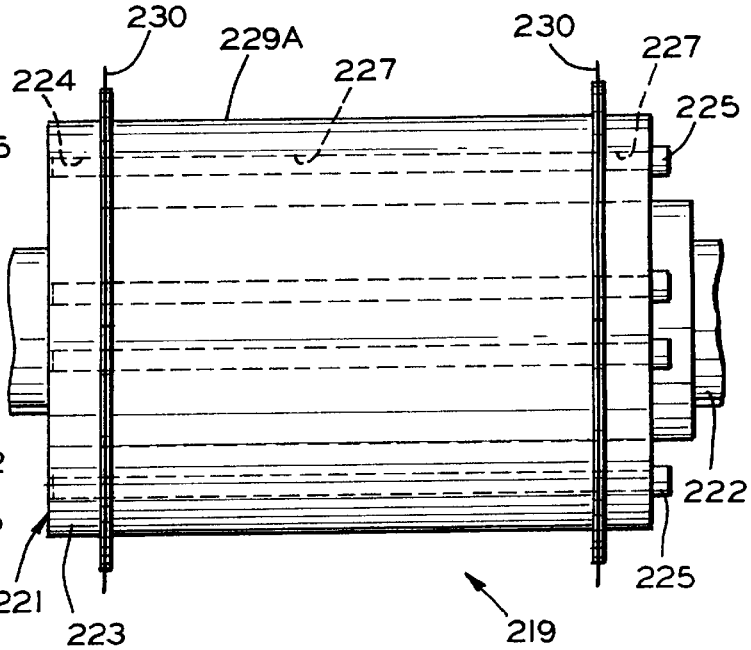
FIG. 38 is a view similar in part to FIG. 36, but showing the slitting means set up to hold two widely spaced slitting blades.

FIG. 38 shows slitting knife assembly 219 having a pair of blades 230 mounted between flange 223 of hub 221, a wide spacer 229A and an outer hub 226.

Figure 36:
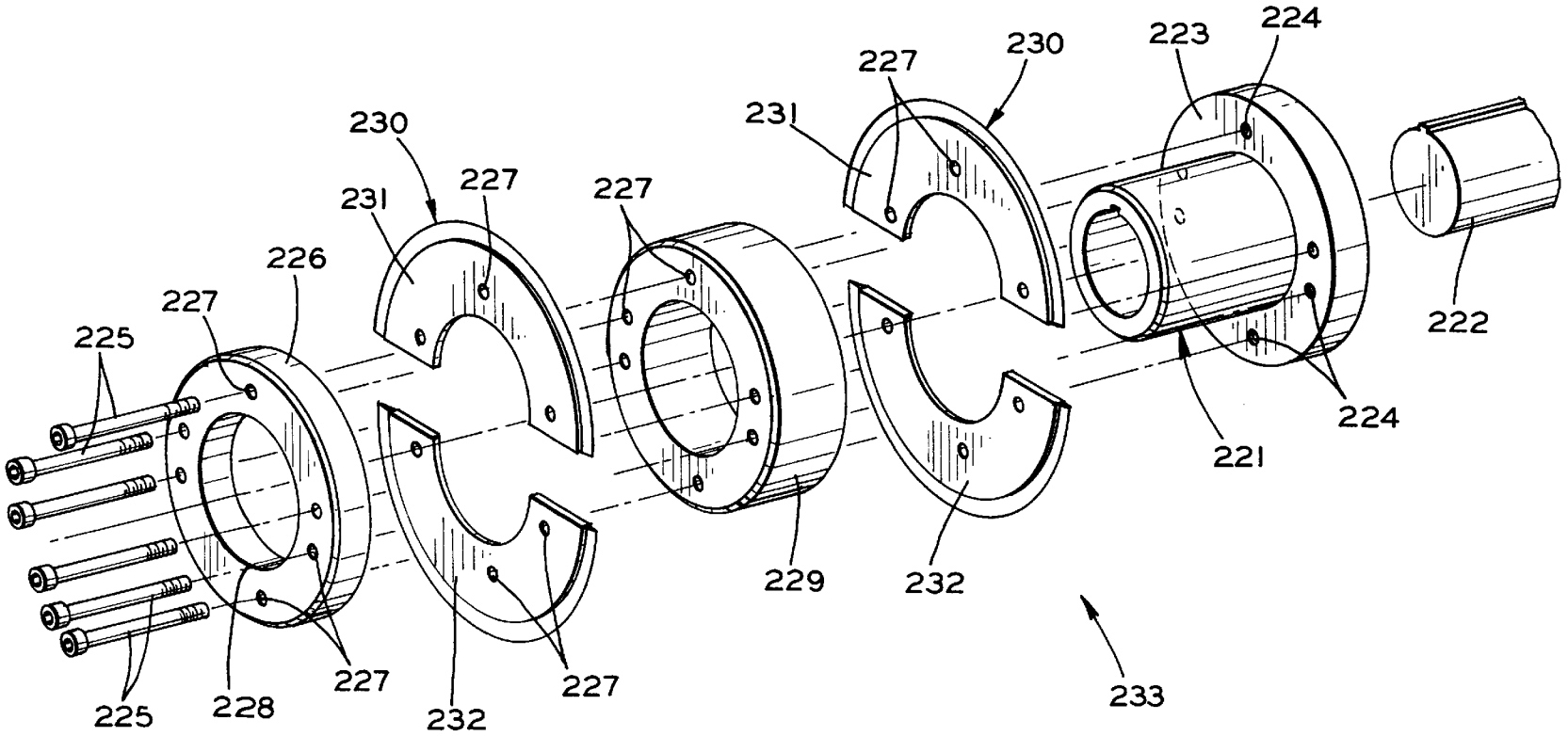
FIG. 36 is a exploded perspective view of a slitting means embodying the construction of the present invention.
Figure 39:
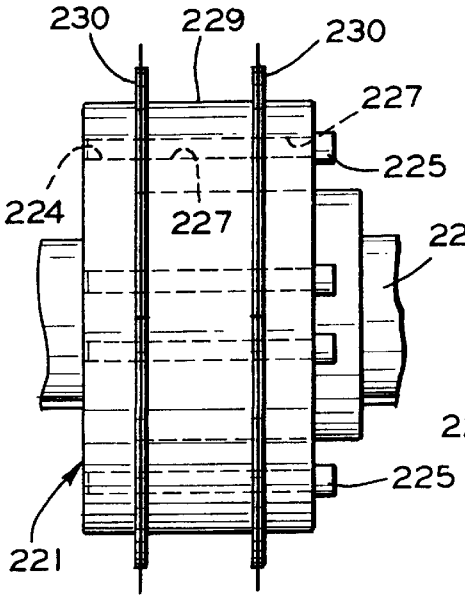
FIG. 39 is similar in part to FIG. 36, but showing the slitting means set up to hold two spaced apart slitting blades.
Figure 40:
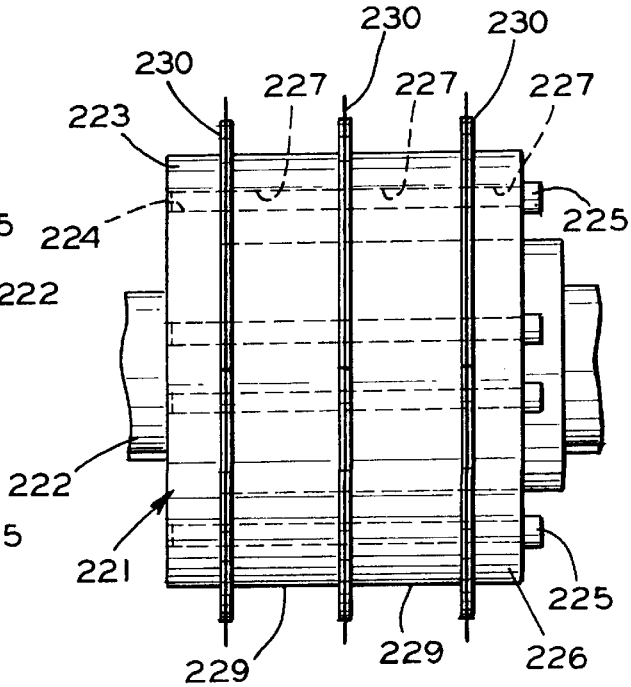
FIG. 40 is a view in similar in part to FIG. 36, but showing the slitting means set up to hold three spaced apart slitting blades.

FIG. 39 shows the construction of FIG. 36 in its assembled condition. FIG. 40 shows a construction similar to FIG. 39, but having an additional spacer member 229 and an additional slitting blade 230 mounted thereon.

Figure 41:
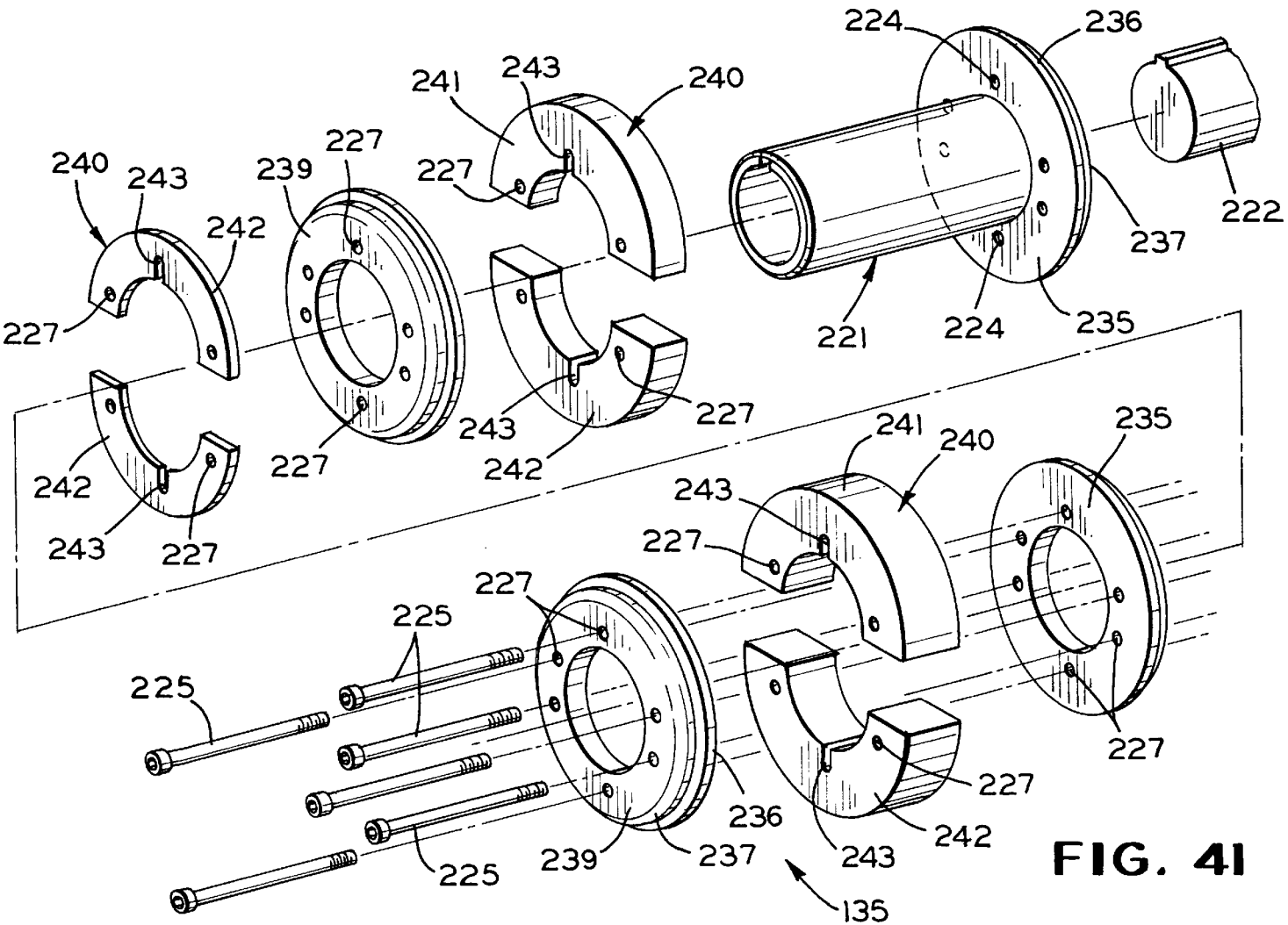
FIG. 41 is an exploded perspective view of a scoring/crushing means embodying the construction of the present invention.

A similar innovation is made in providing the fully adjustable scoring/crushing means 133. An exploded view of the second scoring and crushing assembly 135, which forms a part of the scoring/crushing means 133 is shown by way of example in FIG. 41. A hub 221 is mounted to a keyed shaft 222. The threaded openings 224 are again provided, but instead of flange 223, there is provided an outer or first portion of a scoring head 235 having scoring portion 236 and radius portion 237. Scoring portion 236, by way of example, would make the scores labeled F,G,H,I,J, and K illustrated on the cross-stringer blank in FIG. 5, while the radius portions would make the radiuses, for example, shown at the edges of panels 76,78 and 80.

Figure 43:
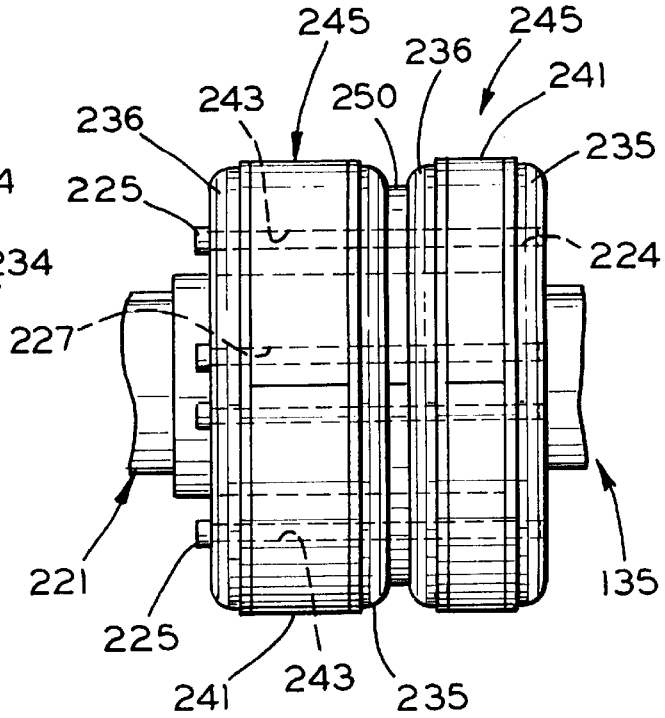
FIG. 43 is a view similar in part to FIG. 41, but showing the scoring/crushing means set up to have two different width scoring heads separated by a spacer.

In place of outer flange 226 is provided a second or outer portion of a scoring head 239, in which are provided the spaced apertures 227. As many inner portions of scoring heads 235, or outer portions of scoring heads 239, as desired may be provided. It is noted that the second scoring/crushing head assembly 235, as contrasted to the second adjustable slitting knife assembly 233, the scoring heads 235 and 239 are solid, while it is the spacers (crushing section of assembly) 240 that are split, having an upper portion 241 and a lower portion 242. Spaced apertures 227 are provided, but a pair of opposed spaced apertures 227 are replaced by a pair of opposed slots 243. Thus, the spacers work just like the slitting blades of the prior assembly when the scoring arrangement provided by the second adjustable scoring head assembly 135 need to be changed. The threaded fasteners 225 are simply loosened, the desired spacers (crushing section) 240 are removed, or added as required, and the threaded fasteners 225 are simply re-tightened making for a quick and easy changeover of the second adjustable scoring/crushing head assembly 135 without any disassembly, and with minimum downtime to the apparatus of the present invention. It can be seen that the spacers/crushers 240 may be of widely varying thicknesses as desired. FIG. 43 shows the second scoring/crushing assembly 135 in its assembled condition.

Figure 42:
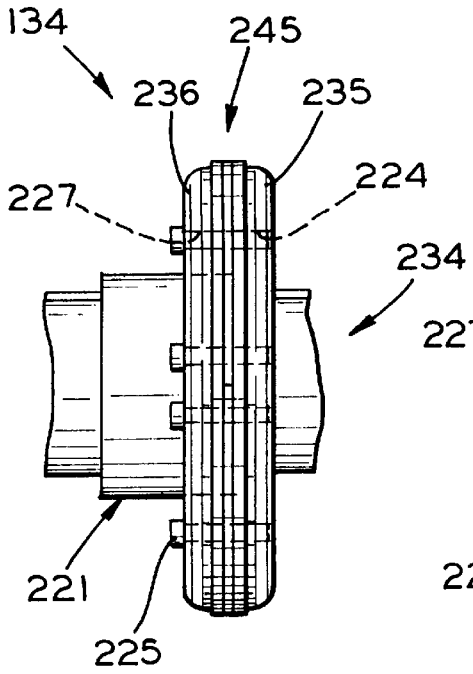
FIG. 42 is a view similar in part to that shown in FIG. 41, but showing a scoring/crushing means having a single scoring head.

Referring to FIG. 42, there is shown a modified scoring/crushing head assembly 234 having a scoring/crushing head 245 formed of a single outer or right side portion of a scoring head 235, and a single outer or left side portion of a scoring/crushing head 236, mounted on the hub 221. It can be understood that the addition of a suitable spacer between right side portion of scoring head 235 and left side portion of scoring head 236 would produce the construction shown in FIG. 10 for the first adjustable scoring/crushing head assembly 134.

Figure 44:
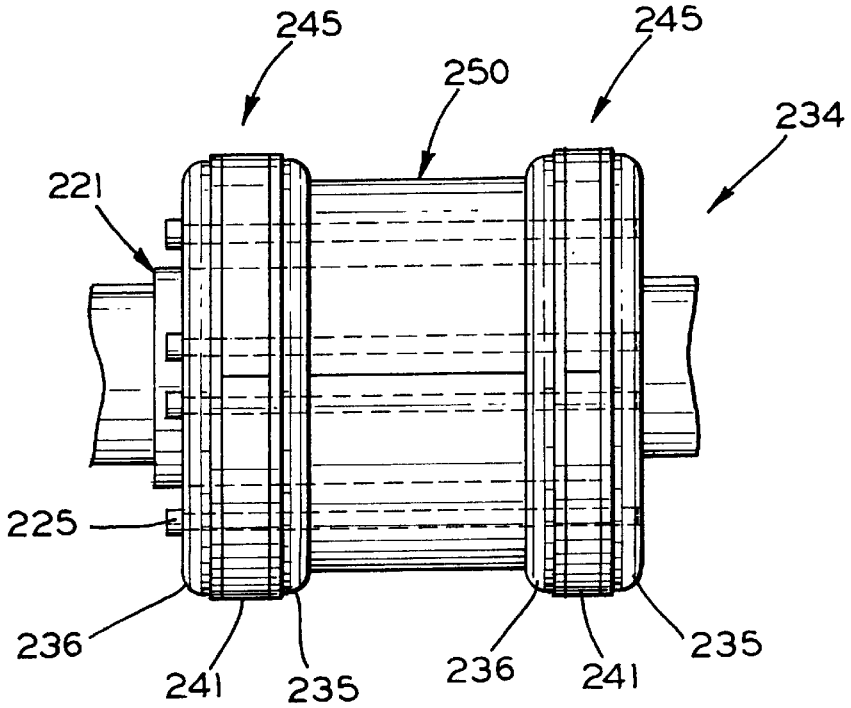
FIG. 44 is a view similar in part to FIG. 41, but showing a scoring/crushing means set up to have two different width scoring heads separated by a wide spacer.
Figure 45:
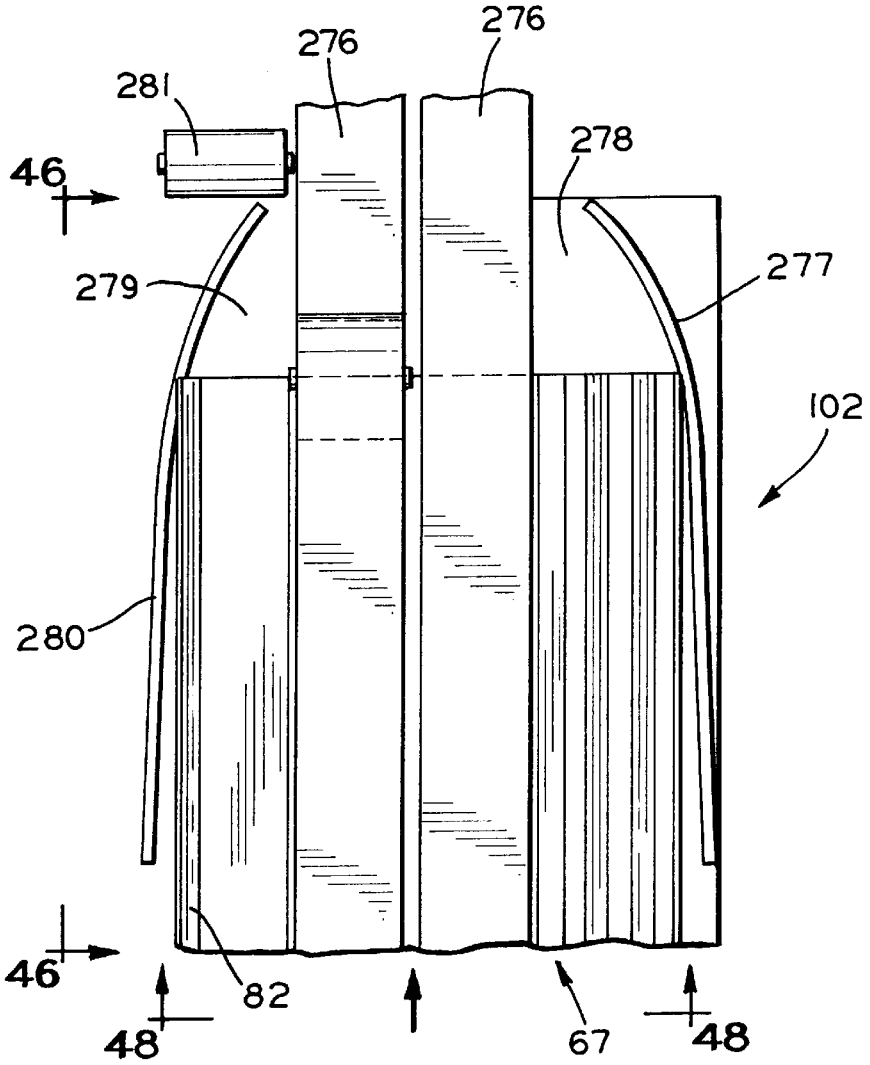
FIG. 45 is a diagrammatic plan view of a gathering device or section embodying the construction of the present invention being used to gather and pre-fold a cross-stringer.
Figure 46:
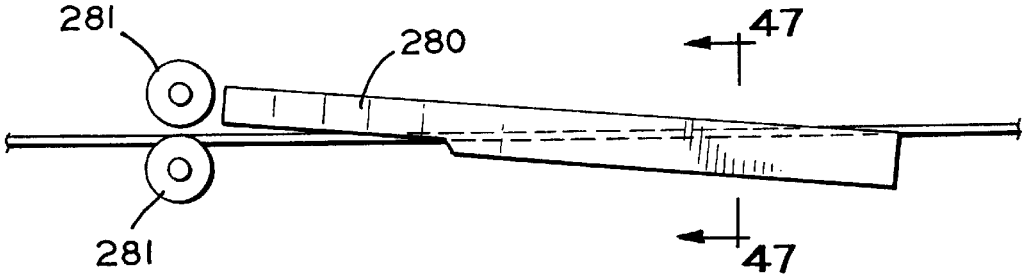
FIG. 46 is an elevational view of the construction shown in FIG. 45, taken in the direction of the arrows, along the view line 46—46 of FIG. 45.
Figure 47:
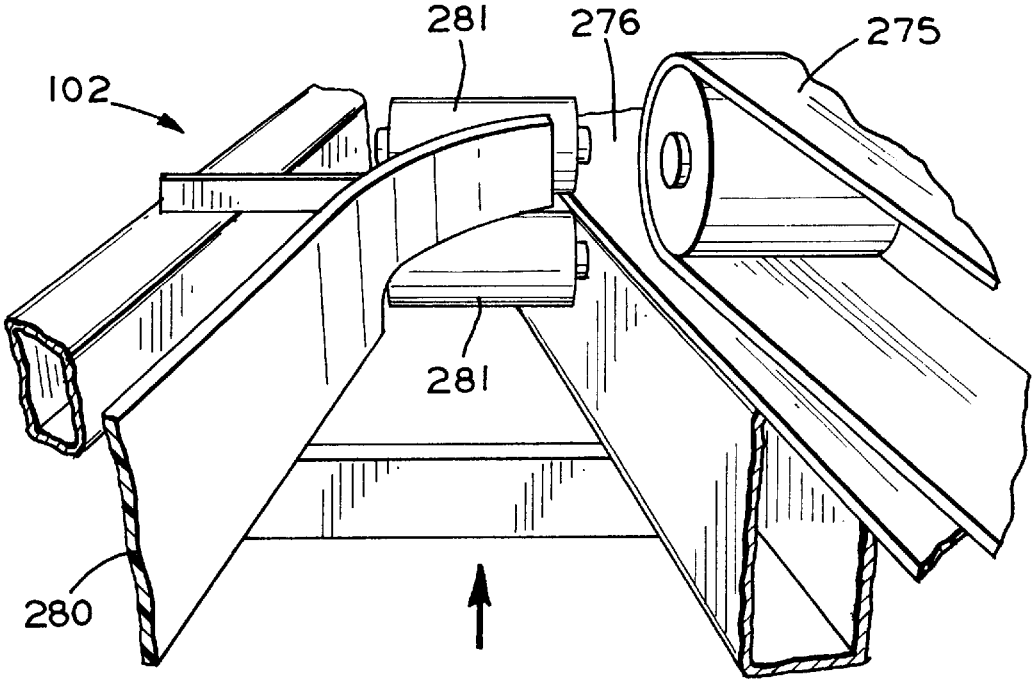
FIG. 47 is a partial, sectional, diagrammatic view, taken in the direction of the arrows, along the section line 47—47 of FIG. 46.
Figure 48:
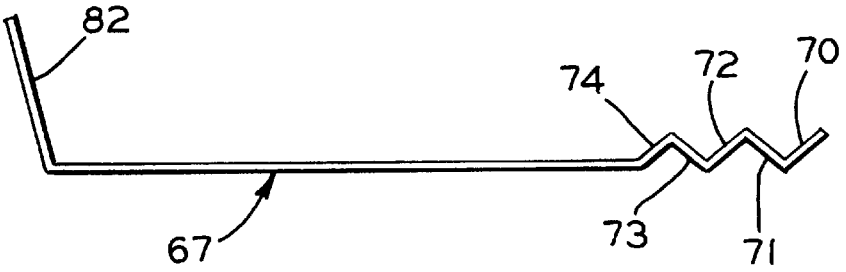
FIG. 48 is a sectional view, taken in the direction of the arrows, along the section line 48—48 of FIG. 45.
Figure 49:
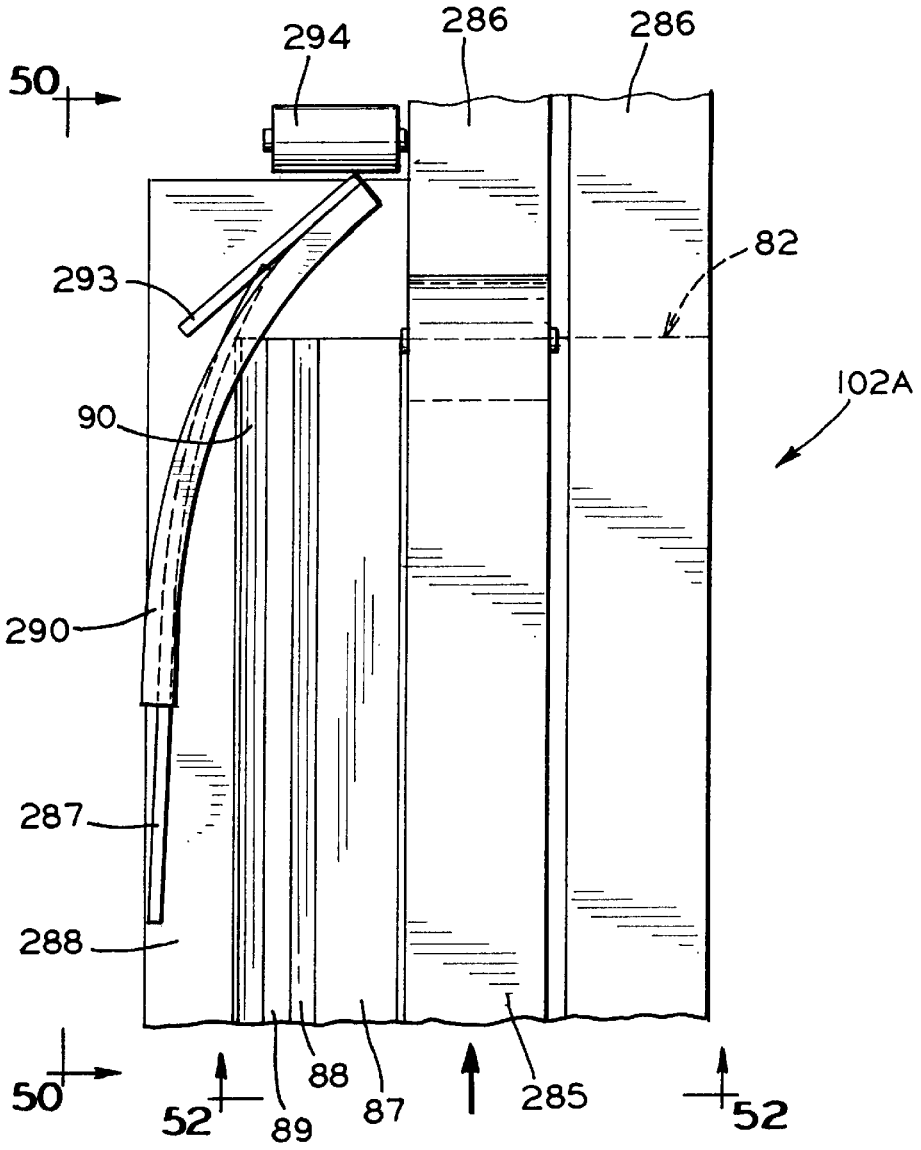
FIG. 49 is a modification of the construction shown in FIG. 45 being used to gather and pre-fold a stringer.
Figure 50:
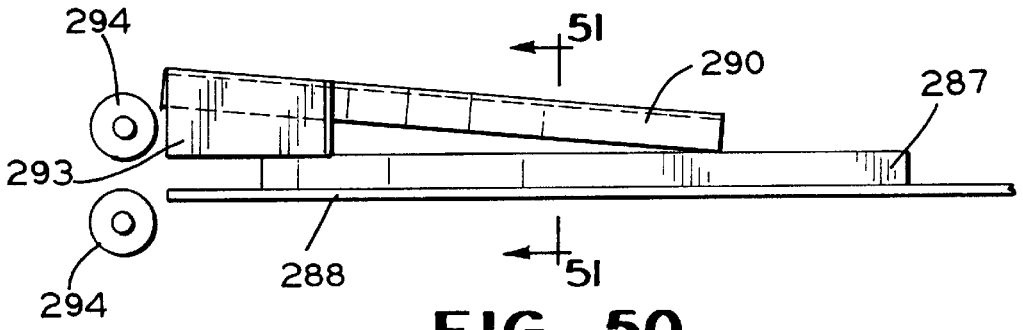
FIG. 50 is an elevational view of the construction shown in FIG. 49, taken in the direction of the arrows, along the view line 50—50 of FIG. 49.
Figure 51:
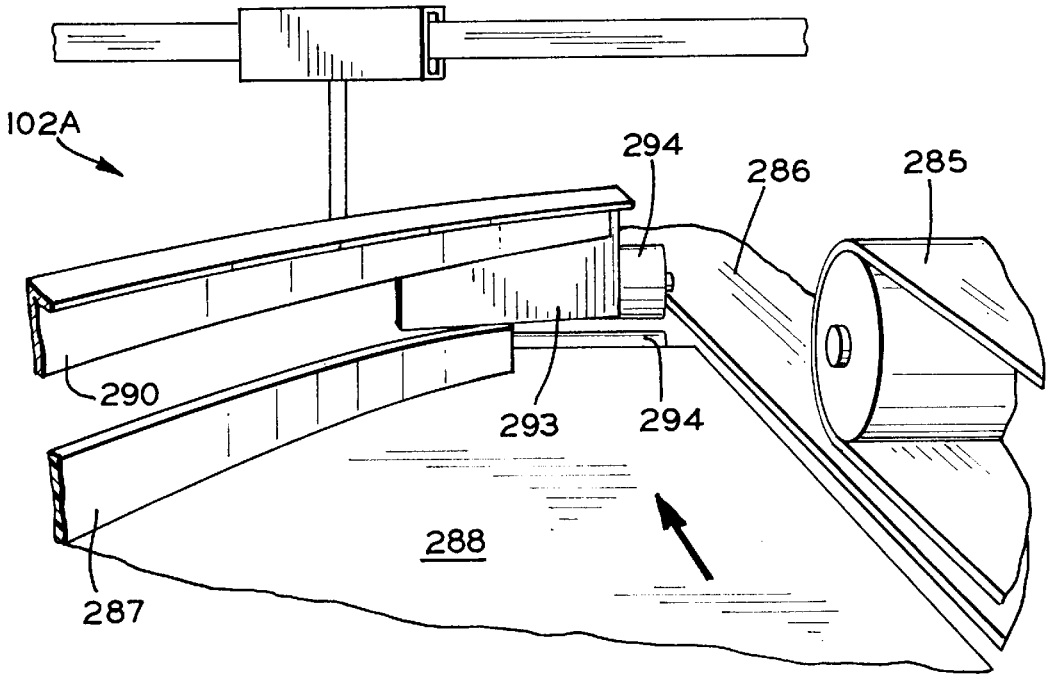
FIG. 51 is a partial, sectional, diagrammatic view, taken in the direction of the arrows, along the section line 51—51 of FIG. 50.
Figure 52:
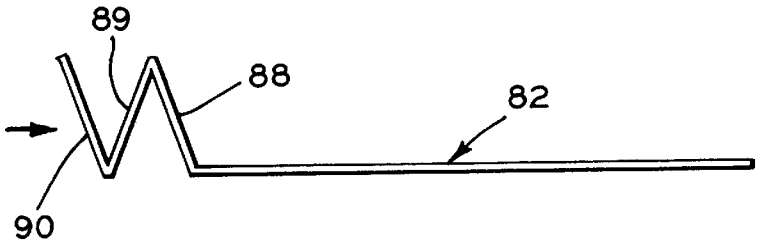
FIG. 52 is a partial, sectional, diagrammatic view, taken in the direction of the arrows, along the section line 52—52 of FIG. 49.

FIG. 44 shows a construction similar to FIG. 43, except the smaller diameter spacer 250 is much larger to provide a wide space between the scoring/crushing heads 245.

Thus, by carefully studying the problems present in prior art corrugated paperboard or fiberboard folding devices we have produced a new and novel method and apparatus for folding of corrugated paperboard or fiberboard.

In accordance with the provisions of the patent statutes, the present invention has been described in what is considered to represent its preferred embodiment. However, it should be noted that the invention can be practiced otherwise than as specifically illustrated and described without departing from its spirit or scope.

We claim:

1. An apparatus for folding of sheet material in a continuous process including seriatim:

a) a slitting and scoring/crushing means having at least one vertically adjustable thickness qualifying roller to provide a predetermined series of panels in a blank of said sheet material;

b) a panel identifying means having identifying rollers to identify and slightly fold at least some of said panels formed in said sheet material by said slitting and scoring/crushing means;

c) at least one glue station;

d) at least one gathering and pre-folding means; and, e) at least one active folding means having at least one hinge.

2. The apparatus defined in claim 1, wherein said slitting and scoring/crushing means is adjustable with respect to a predetermined planar path of movement and includes seriatim:

a) a first lower feed roller in a 180° opposed relationship to a first adjustable qualifying roller, b) a scoring/crushing means downstream from said first lower feed roller, c) a first slitting means downstream from said scoring/crushing means, d) a second slitting means downstream from said first slitting means, and e) a second lower feed roller downstream from said second slitting means in a 180° opposed relationship to a second adjustable qualifying roller.

3. The apparatus defined in claim 2, wherein the surface of said first lower feed roller is in said planar path of movement, and said first qualifying roller is adjustable with respect to said planar path of movement.

4. The apparatus defined in claim 3, wherein said scoring/crushing means includes:

a) a roller having its' surface in said planar path of movement, b) an adjustable scoring crushing head assembly mounted above said planar path of movement and adjustable toward and away from said planar path of movement, said scoring crushing head assembly including:

i) a shaft, and ii) at least one scoring crushing head fixedly, but removably, mounted to said shaft.

5. The apparatus defined in claim 4, wherein said first slitting means include;

a) a metal roller having its surface in said planar path of movement, and b) a first adjustable slitting knife assembly in a 180° opposed relationship to said metal roller.

6. The apparatus defined in claim 5, wherein said first adjustable slitting knife includes:

i) a shaft, and ii) at least one split slitting blade fixedly, but removably, mounted to said shaft.

7. The apparatus defined in claim 6, wherein said second slitting means includes:

a) a second shaft mounted for rotation above said planar path of movement, b) at least one second slitting knife assembly mounted to said second shaft, said second slitting knife assembly adjustable toward and away from said planer path of movement, c) a second metal roller in a 180° opposed relationship to said second slitting knife assembly.

8. The apparatus defined in claim 7, wherein said second qualifying roller is adjustable toward and away from said planar path of movement.

9. The apparatus defined in claim 1, wherein said identifying means include;

a) a first shaft suitably mounted for rotation above and transverse to said planar path of movement and downstream of said slitting and scoring/crushing means, b) a first plurality of identifying rollers mounted to said first shaft in a laterally spaced relationship, c) a second shaft suitably mounted for rotation below said planar path of movement, and below said first shaft, and d) a second plurality of identifying rollers mounted to said second shaft in a laterally spaced relationship.

10. The apparatus defined in claim 9, wherein:

a) each of said first plurality of identifying rollers, and each of said second plurality of identifying rollers are V-shaped.

11. The apparatus defined in claim 10, wherein:

a) each of said first plurality of identifying rollers is offset from each of said second plurality of identifying rollers by a predetermined distance.

12. The apparatus defined in claim 11, wherein the tip of each of said first plurality of identifying rollers is spaced below the tip of each of said second plurality of identifying rollers.

13. The apparatus defined in claim 1, wherein said at least one gathering and pre-folding station includes:

a) a cross-stringer gathering and pre-folding section.

14. The apparatus defined in claim 13, wherein said at least one gathering and pre-folding station includes:

a) a first low friction surface, b) an inwardly curving, curvilinear guide rail mounted to said first low friction surface, and c) an upwardly inclined, inwardly curving, curvilinear lifting rail.

15. The apparatus defined in claim 14, and further including:

a) at least one upper transfer belt, and b) at least one lower transfer belt.

16. The apparatus defined in claim 15, wherein said first low friction surface, said inwardly curving, curvilinear guide rail mounted to said first low friction surface, and said upwardly inclined, inwardly curving, curvilinear lifting rail, are all made of UHMV.

17. The apparatus defined in claim 1, wherein said at least one gathering and pre-folding station includes:

a) a stringer gathering and pre-folding section.

18. The apparatus defined in claim 17, wherein said stringer gathering and pre-folding section includes:

a) at least one upper transfer belt, and b) at least one lower transfer belt.

19. The apparatus defined in claim 18, wherein said stringer gathering and pre-folding section further includes:

a) a second low-friction surface.

20. The apparatus defined in claim 19, wherein said stringer gathering and pre-folding section further includes:

a) a flat, curvilinear rail mounted adjacent to said second low-friction surface.

21. The apparatus defined in claim 20, and further including:

a) a curvilinear, upwardly inclined, L-shaped channel, said curvilinear, upwardly inclined, L-shaped channel being elevated with respect to said second low-friction surface and said flat, curvilinear rail.

22. The apparatus defined in claim 21, wherein said flat, curvilinear rail and said curvilinear, upwardly inclined, L-shaped channel are both made of UHMV.

23. The apparatus defined in claim 1, wherein said at least one active folding means comprise:

a) a first active cross-stringer folding means, b) a second active cross-stringer folding means, c) a third active cross-stringer folding means, and d) a fourth active cross-stringer folding means.

24. The apparatus defined in claim 1, wherein said at least one folding means comprise:

a) a first active stringer folding means, b) a second active stringer folding means, c) a third active stringer folding means.

25. The apparatus defined in claim 23, wherein said first active cross-stringer folding means includes:

a) a base having at least one upper conveyor belt and at least one lower conveyor belt to drive a partially formed cross-stringer blank therebetween, b) a single hinged folding member attached to said base, said single hinged folding member including:

i) a mounting portion ii) a hinge member attached to said base and to said mounting portion to hingedly attach single hinged folding member to said base, and:

iii) an angled member.

26. The apparatus defined in claim 25, and including:

a) a bracket mounted to said base to support said angled member in its open position.

27. The apparatus defined in claim 26, and including a fluid powered cylinder connected between said base and said angled member to rotate said angled member between its open position, and its rotated position, on command.

28. The apparatus defined in claim 27, and further including:

a) a second fluid operated cylinder having a shaft, b) an adapter attached to said shaft, and c) an adjustable arm attached to said adapter by a fastening means, said adjustable arm extendable by said fluid cylinder to bear on said partially formed cross-stringer blank until said angled member approaches its rotated position.

29. The apparatus defined in claim 24, wherein said second, active folding means includes:

a) a double hinged folding means.

30. The apparatus defined in claim 29, wherein said double hinged folding means includes:

a) a first hinge portion, b) a first hinge connected to said first hinge portion, c) a second hinge portion connected to said first hinge, d) a second hinge connected to said second hinge portion, e) a third, substantially C-shaped, hinge portion connected to said second hinge.

31. The apparatus defined in claim 30, and further including:

a) a stop member attached to said second hinge portion, said stop member including, i) an angled arm portion, and ii) a stop portion.

32. The apparatus defined in claim 31, and further including a stop bracket connected to said third substantially C-shaped, hinge portion.

33. The apparatus defined in claim 32, and further including an adjustable stop means connected to said stop bracket, said adjustable stop means cooperating with said stop portion of said stop member to limit rotation of said third substantially C-shaped, hinge portion.

34. The apparatus defined in claim 33, and including a third fluid powered cylinder connected to a cylinder mounting bracket connected to said third substantially C-shaped, hinge portion.

35. The apparatus defined in claim 24, wherein said third, active folding means includes:

a) a modified double hinged folding means.

36. The apparatus defined in claim 35, wherein said modified double hinged folding means includes:

a) a first hinge portion, b) a first hinge connected to said first hinge portion, c) a second hinge portion connected to said first hinge, d) a second hinge connected to said second hinge portion, e) a third, substantially L-shaped portion connected to said second hinge.

37. The apparatus defined in claim 36, and further including:

a) a stop member attached to said second hinge portion, said stop member including, i) an angled arm portion, and ii) a stop portion.

38. The apparatus defined in claim 37, and further including a stop bracket connected to said third substantially L-shaped, portion.

39. The apparatus defined in claim 38, and further including an adjustable stop means connected to said stop bracket, said adjustable stop means cooperating with said stop portion of said stop member to limit rotation of said third substantially L-shaped, portion.

40. The apparatus defined in claim 39, and including a fourth fluid powered cylinder connected to a cylinder mounting bracket connected to said third substantially L-shaped, portion.

41. An apparatus for folding of sheet material in a continuous process including seriatim:

a) a slitting and scoring/crushing means having at least one vertically adjustable thickness qualifying roller to provide a predetermined series of panels in a blank of said sheet material;

b) a panel identifying means having identifying rollers to identify and slightly fold at least some of said panels formed in said sheet material by said slitting and scoring/crushing means;

c) at least one glue station;

d) at least one gathering and pre-folding means; and, e) at least one active folding means.

42. An apparatus for folding of sheet material in a continuous process including seriatim:

a) a slitting and scoring/crushing means having at least one adjustable thickness qualifying roller;

b) a panel identifying means having identifying rollers;

c) at least one glue station;

d) at least one gathering and pre-folding means;

and, e) at least one active folding means having at least one hinge.

* * * * *